US012270127B2

(12) United States Patent
Sun et al.

(10) Patent No.: US 12,270,127 B2
(45) Date of Patent: Apr. 8, 2025

(54) ANTIBACTERIAL AND ANTIVIRAL FABRICS

(71) Applicant: The Regents of the University of California, Oakland, CA (US)

(72) Inventors: Gang Sun, Davis, CA (US); Peixin Tang, Davis, CA (US)

(73) Assignee: The Regents of the University of California, Oakland, CA (US)

( * ) Notice: Subject to any disclaimer, the term of this patent is extended or adjusted under 35 U.S.C. 154(b) by 596 days.

(21) Appl. No.: 17/498,975

(22) Filed: Oct. 12, 2021

(65) Prior Publication Data

US 2022/0112629 A1 Apr. 14, 2022

Related U.S. Application Data

(60) Provisional application No. 63/104,702, filed on Oct. 23, 2020, provisional application No. 63/091,813, filed on Oct. 14, 2020.

(51) Int. Cl.
*D01F 1/10* (2006.01)

(52) U.S. Cl.
CPC ..... *D01F 1/103* (2013.01); *D01F 1/106* (2013.01); *D10B 2201/02* (2013.01); *D10B 2401/13* (2013.01)

(58) Field of Classification Search
CPC ..... D01F 1/103; D01F 1/106; D10B 2201/02; D10B 2401/13
See application file for complete search history.

(56) References Cited

U.S. PATENT DOCUMENTS

| | | | | |
|---|---|---|---|---|
| 2003/0083492 | A1* | 5/2003 | Shannon | D21H 17/29 536/123 |
| 2015/0173479 | A1* | 6/2015 | Adams | A61K 8/44 424/70.2 |
| 2016/0154145 | A1 | 6/2016 | Abe et al. | |

FOREIGN PATENT DOCUMENTS

WO 2022/087350 A1 4/2022

OTHER PUBLICATIONS

Yang et al. (polymer J (2018; 50, 33-44).*
International Search Report and Written Opinion in PCT/US2021/056168; Jan. 26, 2022; 6 pages.
Ding, et al.; "Targeted synthesis of a large triazine-based [4+6] organic molecular cage: structure, porosity and gas separation"; *Chem. Commun.*; vol. 51; 2015; pp. 1976-1979.
Hasell, et al.; "Porous organic cages: soluble, modular, molecular pores"; *Nature Reviews Materials*; vol. 1, Article No. 16053; 2016; 26 pages.
Tang, P. et al.; "Daylight-Induced Antibacterial and Antiviral Cotton Cloth for Offensive Personal Protection"; *ACS Appl. Mater. Interfaces*; Oct. 22, 2020; vol. 12, No. 44; pp. 49442-49451 (abstract only).
Sun, G.; "Rechargeable Antibacterial N-Halamine Films with Antifouling Function for Food Packaging Applications"; *ACS Appl. Mater. Interfaces*; vol. 11, No. 19; 2019; pp. 17814-17822.
Huang, C. et al.; "Disinfectant Performance of a Chlorine Regenerable Antibacterial Microfiber Fabric as a Reusable Wiper"; *Materials* (Basel); vol. 12, No. 1; 2019.
Si, Y. et al.; "Biocidal and Rechargeable N-Halamine Nanofibrous Membranes for Highly Efficient Water Disinfection"; *ACS Biomater. Sci. Eng.*; vol. 3, No. 5; 2017; pp. 854-862.
Si, Y. et al.; "Daylight-Driven Rechargeable Antibacterial and Antiviral Nanofibrous Membranes for Bioprotective Applications"; *Sci. Adv.*; vol. 4, No. 3; 2018.
Liu, N. et al.; "Photo-Induced Self-Cleaning Functions on 2-Anthraquinone Carboxylic Acid Treated Cotton Fabrics"; *J. Mater. Chem.*; vol. 21, No. 39; Sep. 2011; pp. 15383-15390.
Zhuo, J. et al.; "Antimicrobial Functions on Cellulose Materials Introduced by Anthraquinone Vat Dyes"; *ACS Appl. Mater. Interfaces*; vol. 5, No. 21; 2013; pp. 10830-10835.
Liu, N. et al.; "Production of Reactive Oxygen Species by Photoactive Anthraquinone Compounds and Their Applications in Wastewater Treatment"; *Industrial and Engineering Chemistry Research*; Apr. 2011; pp. 5326-5333.
Tang, P. et al.; "Fabrication of Robust Functional Poly-Cationic Nanodots on Surfaces of Nucleophilic Nanofibrous Membrane"; *Appl. Surf. Sci.*; vol. 528; 2020; pp. 146587.
Zhang, Z. et al.; "Daylight-Induced Antibacterial and Antiviral Nanofibrous Membranes Containing Vitamin K Derivatives for Personal Protective Equipment"; *Submitted to ACS Appl. Mater. Interfaces*; 2020.
Tang, P. et al.; "Generation of Hydroxyl Radicals and Effective Whitening of Cotton Fabrics by H2O2 under UVB Irradiation"; *Carbohydr. Polym.*; vol. 160; 2017; pp. 153-162.
Zhang, Z. et al.; "Photoactivities of Vitamin K Derivatives and Potential Applications as Daylight-Activated Antimicrobial Agents"; *ACS Sustain. Chem. Eng.*; vol. 7, No. 22; 2019; pp. 18493-18504.

* cited by examiner

*Primary Examiner* — Shirley V Gembeh
(74) *Attorney, Agent, or Firm* — Kilpatrick Townsend and Stockton LLP

(57) ABSTRACT

Disclosure provides antimicrobial fiber, comprising: a cationic or polycationic moiety grafted onto a cellulosic fiber and an anionic photosensitizer. Exposing the antimicrobial cotton fiber to light generates reactive oxygen species (ROS) and induces a biocidal function.

10 Claims, 30 Drawing Sheets

VITAMIN $K_1$

VITAMIN $K_3$

VITAMIN $K_4$

ANTIBACTERIAL AND ANTIVIRAL FABRICS

CROSS-REFERENCE TO RELATED APPLICATIONS

The present application claims priority to U.S. Patent Application No. 63/091,813, filed Oct. 14, 2020, and U.S. Patent Application No. 63/104,702 filed Oct. 23, 2020, each of which is hereby incorporated by reference in its entirety for all purposes.

BACKGROUND

Infectious diseases have always been severe threats to human health and safety globally, and the pandemic of COVID-19 in 2019-2020 has become a once per decade human crisis to many countries. (Metcalf, C. J.; Lessler, J. Opportunities and Challenges in Modeling Emerging Infectious Diseases. *Science*. 2017, 357, 149-152; Belongia, E. A.; Osterholm, M. T. COVID-19 and Flu, a Perfect Storm. *Science*. 2020, 368 (6496)), the COVID-19 pandemic has caused over 23 million confirmed cases and more than 815 thousand death all over the world. (World Health Organization. Coronavirus disease 2019 (COVID-19). Situation Report-197. Updated Aug. 4, 2020.) Since many respiratory infectious diseases are mainly transmitted via aerosol droplets, the application of personal protective equipment (PPE) such as face masks, protective suits, and face shields has shown effective roles in lowering the spread of the diseases. (Gralton, J.; McLaws, M. L. Protecting Healthcare Workers from Pandemic Influenza: N95 or Surgical Masks?*Critical Care Medicine*. 2010, 38 (2), 657-667; Eikenberry, S. E.; Mancuso, M.; Iboi, E.; Phan, T.; Eikenberry, K.; Kuang, Y.; Kostelich, E.; Gumel, A. B. To Mask or Not to Mask: Modeling the Potential for Face Mask Use by the General Public to Curtail the COVID-19 pandemic. *Infect. Dis. Model*. 2020, 5, 293-308; Cheng, V. C. C.; Wong, S. C.; Chuang, V. W. M.; So, S. Y. C.; Chen, J. H. K.; Sridhar, S.; To, K. K. W.; Chan, J. F. W.; Hung, I. F. N.; Ho, P. L.; et al. The Role of Community-Wide Wearing of Face Mask for Control of Coronavirus Disease 2019 (COVID-19) Epidemic Due to SARS-CoV-2. *J Infect*. 2020, 81, 107-114). However, PPE that are widely used can only physically block or electrostatically repel the pathogens with limited lifetime, usually within several hours. Any live infectious pathogens surviving on the surface of the contaminated PPE could still post cross-contaminations during its reuses and disposal. However, sterilization and reuse of the current PPE have been an emergency practice during the COVID-19 pandemic due to the global shortage of supplies. (Liao, L.; Xiao, W.; Zhao, M.; Yu, X.; Wang, H.; Wang, Q.; Chu, S.; Cui, Y.; Can N95 Respirators Be Reused after Disinfection-?How Many Times?*ACS Nano* 2020, 14 (5), 6348-6356). Alternatively, cloth masks are recommended and affirmed as a tool to lower the virus transmittance in public. (Centers for Disease Control and Prevention, CDC calls on Americans to wear masks to prevent COVID-19 spread.) Different cloth materials provide significant filtration efficiency against nanoscale aerosol particles (Konda, A.; Prakash, A.; Moss, G. A.; Schmoldt, M.; Grant, G. D.; Guha, S. Aerosol Filtration Efficiency of Common Fabrics Used in Respiratory Cloth Masks. *ACS Nano* 2020, 14 (5), 6339-6347; Zangmeister, C. D.; Radney, J. G.; Vicenzi, E. P.; Weaver, J. L. Filtration Efficiencies of Nanoscale Aerosol by Cloth Mask Materials Used to Slow the Spread of SARS CoV-2. *ACS Nano* 2020), yet surface contaminated cloth face masks can still be a hazard and potentially contagious. Thus, pathogen inactivation function of the cloth masks has been proposed to inherently reduce cross-contamination during application and improve protection for the public.

Antimicrobial agents can be incorporated onto PPE materials to provide offensive protection by disinfecting and deactivating the pathogens. For instance, rechargeable N-halamine biocidal materials have been designed and intensively studied for food packaging, self-cleaning textiles, and water disinfection. (Ma, Y.; Li, J.; Si, Y.; Huang, K.; Nitin, N.; Sun, G. Rechargeable Antibacterial N-Halamine Films with Antifouling Function for Food Packaging Applications. *ACS Appl. Mater. Interfaces* 2019, 11 (19), 17814-17822; Huang, C.; Chen, Y.; Sun, G.; Yan, K. Disinfectant Performance of a Chlorine Regenerable Antibacterial Microfiber Fabric as a Reusable Wiper. *Materials (Basel)*. 2019, 12 (1), 127; Si, Y.; Li, J.; Zhao, C.; Deng, Y.; Ma, Y.; Wang, D.; Sun, G. Biocidal and Rechargeable N-Halamine Nanofibrous Membranes for Highly Efficient Water Disinfection. *ACS Biomater. Sci. Eng.* 2017, 3 (5), 854-862.) However, release of free chlorine from the N-halamine materials is a health concern when they are used in face masks. Moreover, a plasmonic heating effect of silver nanoparticle coating was successfully applied on N95 masks, achieving improved antimicrobial functions under light illumination, accompanied with an instant temperature increase to around 80° C. on the surface of the masks. (Zhong, H.; Zhu, Z.; You, P.; Lin, J.; Cheung, C. F.; Lu, V. L.; Yan, F.; Chan, C. Y.; Li, G. Plasmonic and Superhydrophobic Self-Decontaminating N95 Respirators. *ACS Nano* 2020.) Although the high temperature could assist the biocidal property of the mask, it also poses concerns during the practical use in contact with mouths and skins. On the other hand, photosensitizers could generate biocidal reactive oxygen species (ROS) in polymers under light exposure (Si, Y.; Zhang, Z.; Wu, W.; Fu, Q.; Huang, K.; Nitin, N.; Ding, B.; Sun, G. Daylight-Driven Rechargeable Antibacterial and Antiviral Nanofibrous Membranes for Bioprotective *Applications. Sci. Adv.* 2018, 4 (3)), and the ROS could damage protein, DNA, and lipid of microorganisms to result in rapid inactivation. Benzophenone, anthraquinone, and xanthene derivatives are representative photoactive compounds and have been applied into polymers and fabrics to provide rapid antibacterial functions with acceptable washing durability and photostability. (Liu, N.; Sun, G.; Zhu, J. Photo-Induced Self-Cleaning Functions on 2-Anthraquinone Carboxylic Acid Treated Cotton Fabrics. *J. Mater. Chem.* 2011, 21 (39), 15383-15390; Zhuo, J.; Sun, G. Antimicrobial Functions on Cellulose Materials Introduced by Anthraquinone Vat Dyes. *ACS Appl. Mater. Interfaces* 2013, 5 (21), 10830-10835; Chen, W.; Chen, J.; Li, L.; Wang, X.; Wei, Q.; Ghiladi, R. A.; Wang, Q. Wool/Acrylic Blended Fabrics as Next-Generation Photodynamic Antimicrobial Materials. *ACS Appl. Mater. Interfaces* 2019, 11 (33), 29557-29568.) Moreover, benzophenone structures were modified on poly(vinyl alcohol-co-ethylene) nanofibrous membrane, achieving daylight-induced bioprotection with excellent bacteria and virus disinfection (i.e., 5-6 logs reduction) under light or even dark condition (Si, Y.; Zhang, Z.; Wu, W.; Fu, Q.; Huang, K.; Nitin, N.; Ding, B.; Sun, G. Daylight-Driven Rechargeable Antibacterial and Antiviral Nanofibrous Membranes for Bioprotective Applications. *Sci. Adv.* 2018, 4 (3)).

In view of the foregoing, what is needed are new ways of fabricating antimicrobial cotton fibers. The present disclosure satisfies this and offers other advantages as well.

BRIEF SUMMARY

The present disclosure provides antimicrobial fabrics and methods of fabricating photo-induced antibacterial and antiviral fabrics (PIFs) through a chemisorption process, which is useful for industrial applications and mass production.

The substrates includes woven and nonwoven fabrics such as cotton, in which cationic or polycationic short chains are covalently grafted to the fabric and thereafter, light-induced antibacterial and antiviral anionic photosensitizers are incorporated by a chemisorption process. Upon exposure to normal light, the PIF used in the present disclosure generates singlet oxygen that kills microorganisms and viruses.

In certain aspects, the disclosure provides an antimicrobial fiber, the antimicrobial fiber comprising: a cationic or polycationic moiety grafted onto a fiber containing a nucleophilic functional group which is a member selected from a hydroxyl, an amino or a pyridyl group; and an anionic photosensitizer.

In certain aspects, cationic or polycationic short chains are covalently formed by a nucleophilic substitution reaction and self-propagation of 2-diethylaminoethyl chloride (DEAE-Cl) on fibers (e.g., cotton). The resultant cationic cotton cloth is denoted as polyDEAE@cotton. The presence of the cationic or polycationic short chains on the cotton fibers makes them unique for incorporation of light-induced antibacterial and antiviral anionic photosensitizers by a chemisorption process.

In certain aspects, cationic or polycationic porous organic polymers (POP) are covalently formed by a condensation reaction between melamine and cyanuric chloride on fibers (e.g., cotton). The resultant cationic mesoporous cotton cloth is denoted as POP@cotton. The presence of the cationic or polycationic mesoporous structures on the cotton fibers makes them unique for incorporation of light-induced antibacterial and antiviral anionic photosensitizers separately by an electrostatic-driven guest-host adsorption process. The resultant antibacterial and antiviral fibers (e.g. cottons) show improved ROS production and bioprotective efficiency under light treatments.

In certain aspects, Rose Bengal or sodium anthraquinone-2-sulfonate can be employed as anionic photosensitizer examples to illustrate the affinity between polyDEAE@cotton and PSs and the bioprotective functions of the PIFs against bacteria and viruses.

In one embodiment, the disclosure provides an antimicrobial fiber, the antimicrobial cotton fiber comprising: a cationic or polycationic moiety grafted onto a cellulosic fiber and an anionic photosensitizer.

In another embodiment, the present disclosure provides an antimicrobial cotton fiber, the antimicrobial cotton fiber comprising: a cationic or polycationic moiety grafted onto a cotton fiber and an anionic photosensitizer. A cationic or polycationic moiety "grafted" onto a cotton fiber includes covalent attachment. In certain aspects, there is an electrostatic interaction between the cationic or polycationic moiety and the anionic photosensitizers (PSs).

In certain aspects, the antimicrobial cotton fiber is antibacterial.

In certain aspects, the antimicrobial cotton fiber is antiviral.

In certain aspects, the cationic or polycationic moiety grafted onto the cellulosic fiber is polyDEAE@cotton, which has formula I:

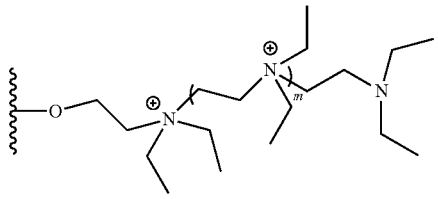

wherein m is a value from 1-10,000. In certain aspects, m is 1-200 or m is 1-100 or m is 1-50, m is 1-25 or m is 1-10 or m is 1, 2, 3, 4, 5, 6, 7, 8, 9 or 10.

In certain aspects, the cationic or polycationic moiety grafted onto a carbon fiber is CHPTAC@cotton, which has formula II:

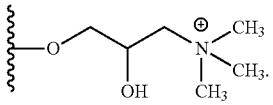

In certain aspects, the cationic or polycationic moiety grafted onto a cellulosic fiber is POP@cotton, which has formula IIIa or IIIb:

a

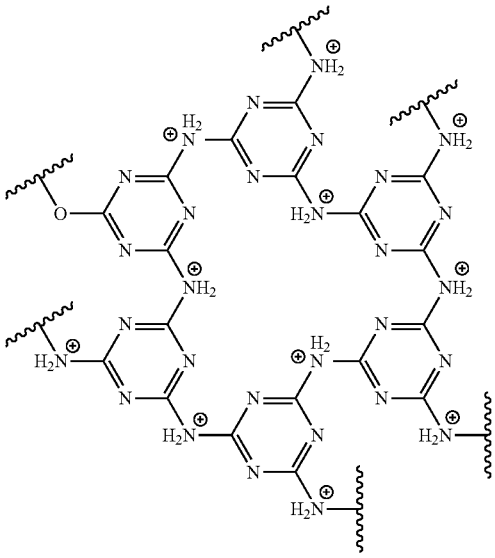

-continued b

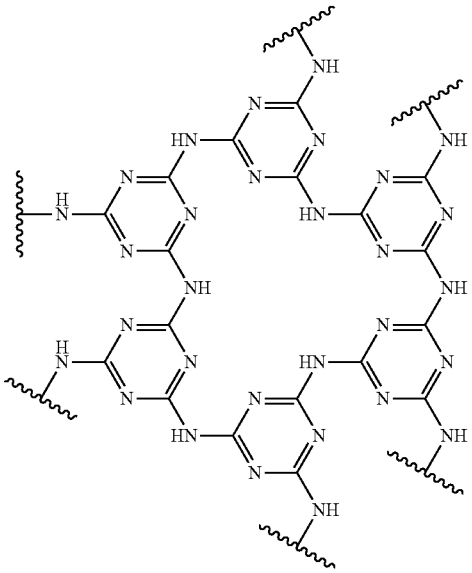

In certain aspects, the anionic photosensitizer is a member selected from the group consisting of Rose Bengal, sodium anthraquinone-2-sulfonate, menadione sodium bisulfite (MSB) (soluble VK3), riboflavin (RF), flavin mononucleotide (FMN), derivatives of vitamin K or flavins. In certain aspects, the anionic photosensitizer is a moiety that generates singlet oxygen or other reactive oxygen species.

In certain aspects, the anionic photosensitizer is Rose Bengal.

In certain aspects, the anionic photosensitizer is sodium anthraquinone-2-sulfonate.

In one embodiment, the disclosure provides a method of generating a biocidal reactive oxygen species (ROS) from an antimicrobial fiber, the method comprising:

providing an antimicrobial fiber comprising a cationic or polycationic moiety grafted onto a cellulosic fiber surface and an anionic photosensitizer; and exposing the antimicrobial fiber to light to generate ROS and induced a biocidal function.

In another embodiment, the disclosure provides a method of generating a biocidal reactive oxygen species (ROS) from an antimicrobial fiber, the method comprising:

providing an antimicrobial fiber comprising a cationic or polycationic moiety grafted onto a cellulosic fiber surface and an anionic photosensitizer; and exposing the antimicrobial cotton fiber to light to generate ROS and induced a biocidal function.

In yet another embodiment, the present disclosure provides a method of generating a biocidal reactive oxygen species (ROS) from an antimicrobial cotton fiber, the method comprising:

providing an antimicrobial cotton fiber comprising a cationic or polycationic moiety grafted onto a cotton fiber surface and an anionic photosensitizer; and exposing the antimicrobial cotton fiber to light to generate ROS and induced a biocidal function.

In certain aspects, the antimicrobial cotton fiber is antibacterial.

In certain aspects, the antimicrobial cotton fiber is antiviral.

In certain aspects, the cationic or polycationic moiety grafted onto the carbon fiber is polyDEAE@cotton, which has formula I:

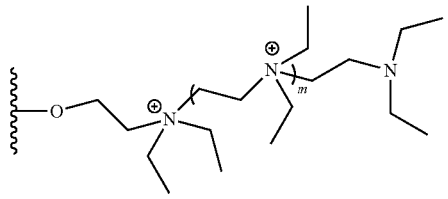

wherein m is a value from 1-10,000. In certain aspects, m is 1-200 or m is 1-100, such as about 1, 2, 3, 4, 5, 6, 7, 8, 9, 10, 11, 12, 13, 14, 15, 16, 17, 18, 19, 20, 21, 22, 23, 24, 25, 26, 27, 28, 29, 30, 31, 32, 33, 34, 35, 36, 37, 38, 39, 40, 41, 42, 43, 44, 45, 46, 47, 48, 49, 50, 51, 52, 53, 54, 55, 56, 57, 58, 59, 60, 61, 62, 63, 64, 65, 66, 67, 68, 69, 70, 71, 72, 73, 74, 75, 76, 77, 78, 79, 80, 81, 82, 83, 84, 85, 86, 87, 88, 89, 90, 91, 92, 93, 94, 95, 96, 97, 98, 99, and/or 100.

In certain aspects, the cationic or polycationic moiety grafted onto a carbon fiber is CHPTAC@cotton, which has formula II:

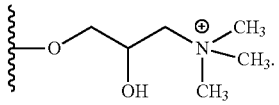

In certain aspects, the cationic or polycationic moiety grafted onto a cellulosic fiber is porous organic polymer POP@cotton, which has formula IIIa or IIIb:

a

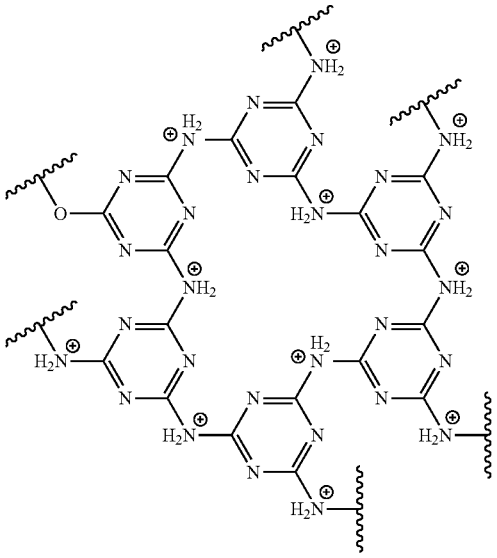

-continued b

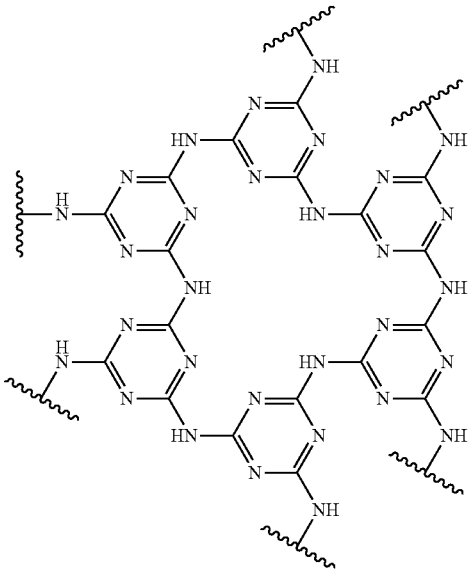

In certain aspects, the anionic photosensitizer is selected from the group consisting of Rose Bengal, sodium anthraquinone-2-sulfonate, vitamin K or derivatives of vitamin K, menadione sodium bisulfite (MSB) (soluble VK3), riboflavin (RF) or a flavin mononucleotide (FMN).

In certain aspects, the anionic photosensitizer is Rose Bengal.

In certain aspects, the anionic photosensitizer is sodium anthraquinone-2-sulfonate The development of PIFs provides offensive protection as face masks and protective suits against pathogen-containing droplets to lower the spread and infection of COVID-19 as well as other infectious diseases.

In another embodiment, the disclosure provides a polyDEAE@cotton together with one or more water soluble anionic functional chemicals to generate novel functional fibers.

These and other aspects, objects and embodiments will become more apparent when read with the detailed description and figures that follow.

BRIEF DESCRIPTION OF THE DRAWINGS

As shown in FIG. 6A, the addition of RB and AQS on the polyDEAE@Cotton through chemisorption can be noticed in the FTIR spectrum after removing the absorbance of polyDEAE@Cotton. In the subtracted spectra (FIG. 6A, second to the bottom trace) and bottom trace (FIG. 6A), the characteristic peaks of RB and AQS were emerged at 1449 $cm^{-1}$ and 1338 $cm^{-1}$, and 1675 $cm^{-1}$, which refer to the C═C stretching vibration (Zeyada, H. M.; Youssif, M. I.; Aboderbala, M. E. O. The Role of the Annealing Temperatures on the Structure and Optical Properties of Rose Bengal Thin Films. 2015, 6 (11), 895-902) and the conjugated ketone stretching (Liu, N.; Sun, G.; Zhu, J. Photo-Induced Self-Cleaning Functions on 2-Anthraquinone Carboxylic Acid Treated Cotton Fabrics. *J. Mater. Chem.* 2011, 21 (39), 15383-15390) in RB and AQS, respectively. In FIG. 6B, the polyDEAE@Cotton showcases a lower decomposition temperature but more residues than that of the pristine cotton, which is attributed to the addition of polyDEAE moieties on cellulose chains. The adsorption of RB and AQS on polyDEAE@Cotton further decreased the decomposition temperature of PIFs and resulted in more residues at 600° C. In addition to visual observation of the color changes of the PIFs, the TGA results also demonstrate the component variations after the photosensitizers adsorption.

DETAILED DESCRIPTION

I. Embodiments

Figure 1A:
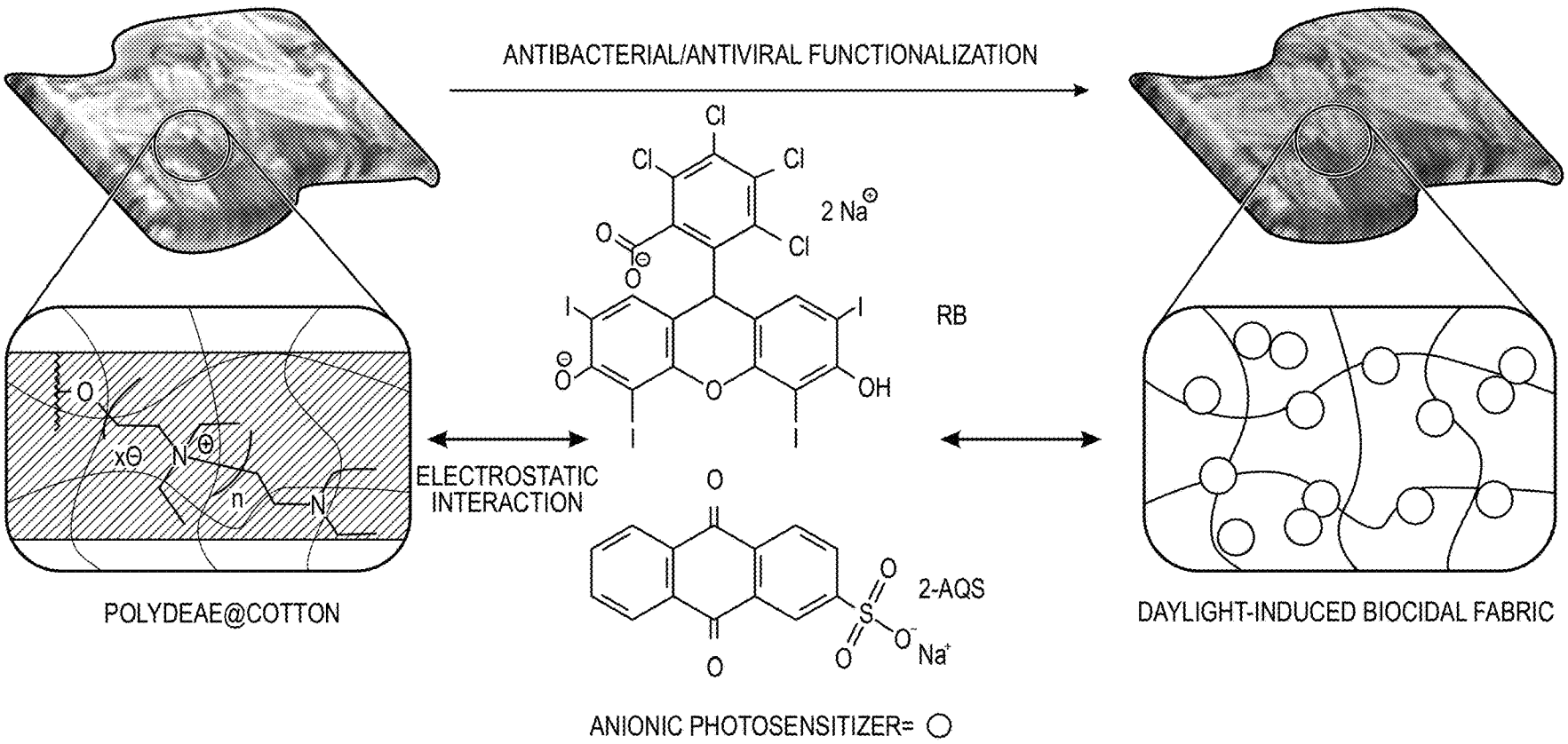
FIG. 1A illustrates schematic illustration of the fabrication of daylight-induced antibacterial and antiviral textiles.
Figure 1B:
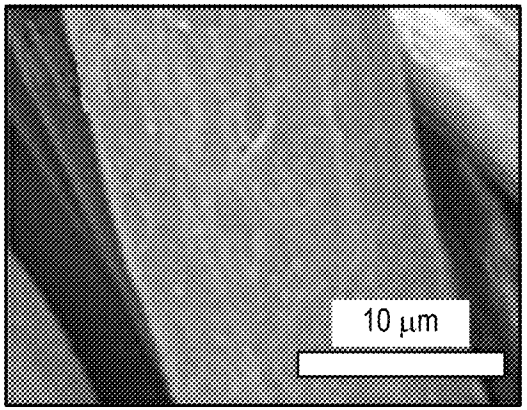
FIG. 1B illustrates SEM images of cotton.
Figure 1C:
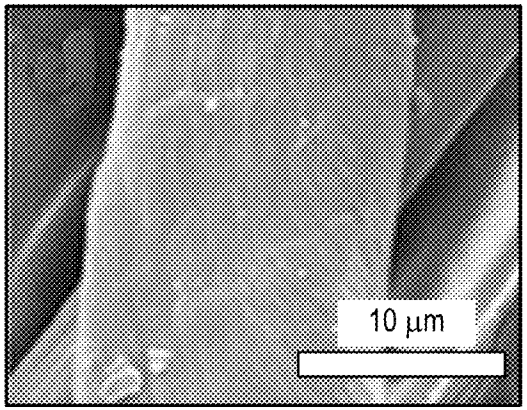
FIG. 1C illustrates images of polyDEAE@cotton.
Figure 1D:
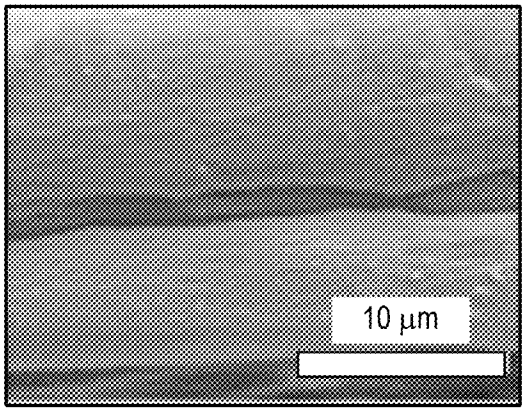
FIG. 1D illustrates RB-dyed polyDEAE@cotton.
Figure 1E:
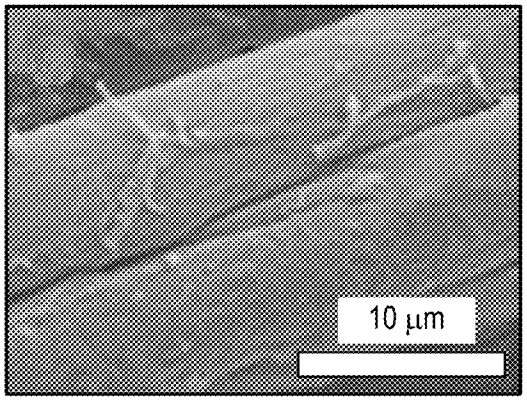
FIG. 1E illustrates 2-AQS-dyed polyDEAE@cotton.

In certain aspects, the antimicrobial surfaces include materials such as textiles, a fiber, a yarn or a natural or synthetic fabric. The materials are suitable for manufacturing objects, like personal protective equipment such as clothing, bandages, sutures, protective gear, gowns, containers, face masks, and the like. In certain aspects, the substrates for the antimicrobial surfaces used in the present disclosure are woven or non-woven fabrics with some amount of cellulosic fiber, such as in the form of regenerated cellulose, rayon, cotton fibers or wood pulp fibers. In other aspects, the fibers can be blends of polyester, polyethylene, polypropylene, rayon, acrylics, with natural fibers such as cellulose. In certain aspects, the fabric contains some amount of cellulosic fiber.

In one embodiment, the disclosure provides an antimicrobial fiber, the antimicrobial fiber comprising: a cationic or polycationic moiety grafted onto a fiber containing a nucleophilic functional group which is a member selected from a hydroxyl, an amino or a pyridyl group; and an anionic photosensitizer.

In another embodiment, the present disclosure provides an antimicrobial cotton fiber, the antimicrobial cotton fiber comprising: a cationic or polycationic moiety grafted onto a cotton fiber and an anionic photosensitizer. The antimicrobial cotton fiber or fabric is a photo-induced fabric (PIF).

In one embodiment, the disclosure provides a method of generating a biocidal reactive oxygen species (ROS) from an antimicrobial fiber, the method comprising:

providing an antimicrobial fiber comprising a cationic or polycationic moiety grafted onto a cellulosic fiber surface and an anionic photosensitizer; and exposing the antimicrobial fiber to light to generate ROS and induced a biocidal function.

In another embodiment, the present disclosure provides a method of generating a biocidal reactive oxygen species (ROS) from an antimicrobial cotton fiber, the method comprising:

providing an antimicrobial cotton fiber comprising a cationic or polycationic moiety grafted onto a cotton fiber surface and an anionic photosensitizer; and exposing the antimicrobial cotton fiber to light to generate ROS and induced a biocidal function.

The materials that have been subjected to surface modification according to the disclosure demonstrate excellent antimicrobial properties. Antimicrobial properties include the ability to resist growth of single cell organisms, such as bacteria, fungi, algae, and yeast, as well as mold and combinations thereof.

The compositions and methods disclosed herein are effective against bacteria, which include both Gram positive bacteria and Gram negative bacteria. Some examples of Gram positive bacteria include, for example, *Bacillus cereus, Micrococcus luteus*, and *Staphylococus aureus*. Some examples of Gram negative bacteria include, for example, *Escherichia coli, Enterobacter aerogenes, Enterobacter cloacae*, and *Proteus vulgaris*. Strains of yeast include, for example, *Saccharomyces cerevisiae*.

The light-activated process is initiated when the PIF is photo-excited with visible light (e.g., 200 nm-600 nm) and then form triplet states that can generate singlet oxygen at the fabric-bacteria interface. The singlet oxygen can either kill the bacteria (microbe) directly or, in turn, generate other corrosive reactive oxygen species.

In certain aspects, the cationic or the polycationic moiety grafted onto a surface is a positively charged moiety such as a singly, doubly or multi-charged moiety. For example, the cationic or polycationic moiety comprises one, two or more positively charged nitrogen atoms, one, two or more positively charged phosphorous atoms, or one, two or more positively charged sulfur atoms. In one embodiment, the positively charged moiety comprises one or more charged quaternary ammonium, one or more quaternary phosphonium or one or more sulfonium group(s) or cyclic amine compounds such as an organic porous organic polymer structures (POP).

In certain instances, after the cationic or polycationic moiety is grafted onto a fiber, a photosensitizer is electrostatically attached. The anionic photosensitizers are anionic molecules that are capable of providing a source of singlet oxygen in accordance with the present disclosure and include benzophenone, anthraquinone, xanthene derivatives, fluorescein derivatives, Rose Bengal, alkali metal salts of Rose Bengal, 4,5,6,7-tetrachloro-2',5',7'-tetraiodo fluorescein, menadione sodium bisulfite (MSB) (soluble $VK_3$), riboflavin (RF), a flavin mononucleotide (FMN), derivatives of vitamin K or flavins.

In certain aspects, the design of photo-induced fabric (PIFs) disclosed herein was guided by three criteria: (i) the PIFs can be easily fabricated with industrial scalability; (ii) the fabrics show efficient antibacterial and antiviral functions under daylight illumination; and (iii) the fabrics provides good surface contact to pathogens to ensure the efficient contact-kill. In order to achieve the first requirement, cotton fabric was selected as an exemplary substrate with the advantages of naturally derived, widely used in cloth face masks, and environmentally friendly. The last two criteria were satisfied by uniquely incorporating cationic or polycationic structures onto cotton fiber surfaces to provide strong electrostatic interactions with anionic photosensitizers (PSs). The antibacterial and antiviral functions resulted from the efficient production of reactive oxygen species (ROS) by the electrostatically incorporated PSs under light illumination. In no way intending to be limiting, two anionic PSs, 2-AQS and RB, were selected as representatives, which generate ROS through different paths under light illumination. (Liu, N.; Sun, G. Production of Reactive Oxygen Species by Photoactive Anthraquinone Compounds and Their Applications in Wastewater Treatment. *Industrial and Engineering Chemistry Research.* 2011, pp 5326-5333.; Planas, O.; Macia, N.; Agut, M.; Nonell, S.; Heyne, B. Distance-Dependent Plasmon-Enhanced Singlet Oxygen Production and Emission for Bacterial Inactivation. *J. Am. Chem. Soc.* 2016, 138 (8), 2762-2768; Wiehe, A.; O'brien, J. M.; Senge, M. O. Trends and Targets in Antiviral Phototherapy. *Photochem. Photobiol. Sci.* 2019, 18 (11), 2565-2612.)

In certain aspects, the fabric or fiber surface in its unmodified state (prior to cationic or polycationic grafting), comprises a hydroxyl group. When the hydroxyl group is attached to a carbon atom in the unmodified solid surface, the surface will generally comprise carbohydrates, proteins, or mixtures thereof. The cellulose may, for example, be in the form of bulk cellulose, or in the form of cotton, linen, rayon, or cellulose acetate or other cotton blends. The cotton may, for example, be cotton cloth, cotton gauze or bulk cotton. The carbohydrates may also be in the form of wood or paper. Other types of material wherein a surface hydroxyl group is attached to a carbon atom include proteinacious materials. Materials comprising proteins include wool and silk. Each of the materials described may exist by itself, or as blends with one or more other materials. For example, any of the forms of cellulose may be blended with other forms of cellulose. Similarly, any of the forms of proteinacious materials described above may be blended with other forms of proteinacious materials. Moreover, any of the forms of cellulose described above may be blended with any of the forms of proteinacious materials described above. For example, wool and silk may be blended with cotton. Also, any of the materials and blends described above may be blended with other natural or synthetic materials, such as nylon and polyesters. The materials may, for example, be fabrics for making clothing or protective garments.

When the hydroxyl group is attached to a silicon atom on a solid surface, the material comprising the solid surface is typically silica, e.g. glass. The glass modified in accordance with the present invention may, for example, be part of a medical instrument.

In certain aspects, in an exemplary fabric or fiber surface, an innovative modification of cotton with DEAE-Cl achieved the growth of cationic or polycationic short chains on the cotton fibers. The presence of the cationic or polycationic short chains (denoted as polyDEAE) on the cotton fibers not only provides the electrostatic interactions for PS functionalization, but also assist the affinity of PIFs to negatively charged bacteria (e.g., *E. coli* and *L. innocua*) and viruses (e.g., enveloped coronavirus), which is beneficial to the biocidal efficiency of the PIFs. The modification of cotton cellulose with polyDEAE is achieved via a two-step reaction, including cotton activation by 120 g/L NaOH solution and polyDEAE growth based on nucleophilic substitution and self-propagation of DEAE-Cl (Scheme 1), wherein m is defined above.

Scheme 1. Modification reaction of cotton by DEAE-Cl.

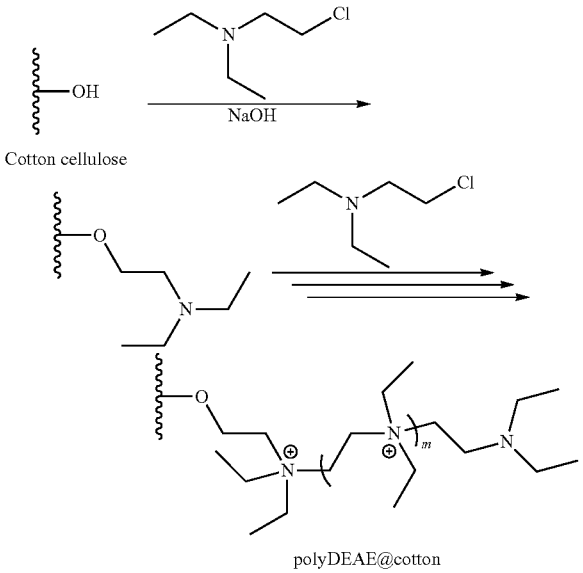

Figure 6A:
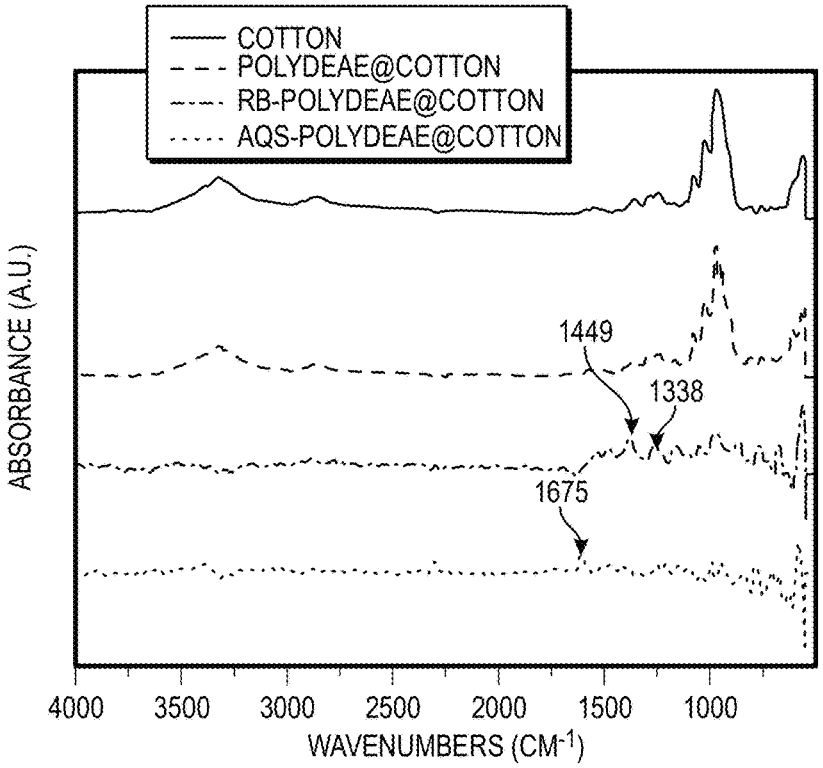
FIG. 6A illustrates FTIR spectra of PIFs. The spectra of RB-polyDEAE@Cotton and AQS@polyDEAE@Cotton were obtained through the subtraction of their original spectra to polyDEAE@Cotton.
Figure 6B:
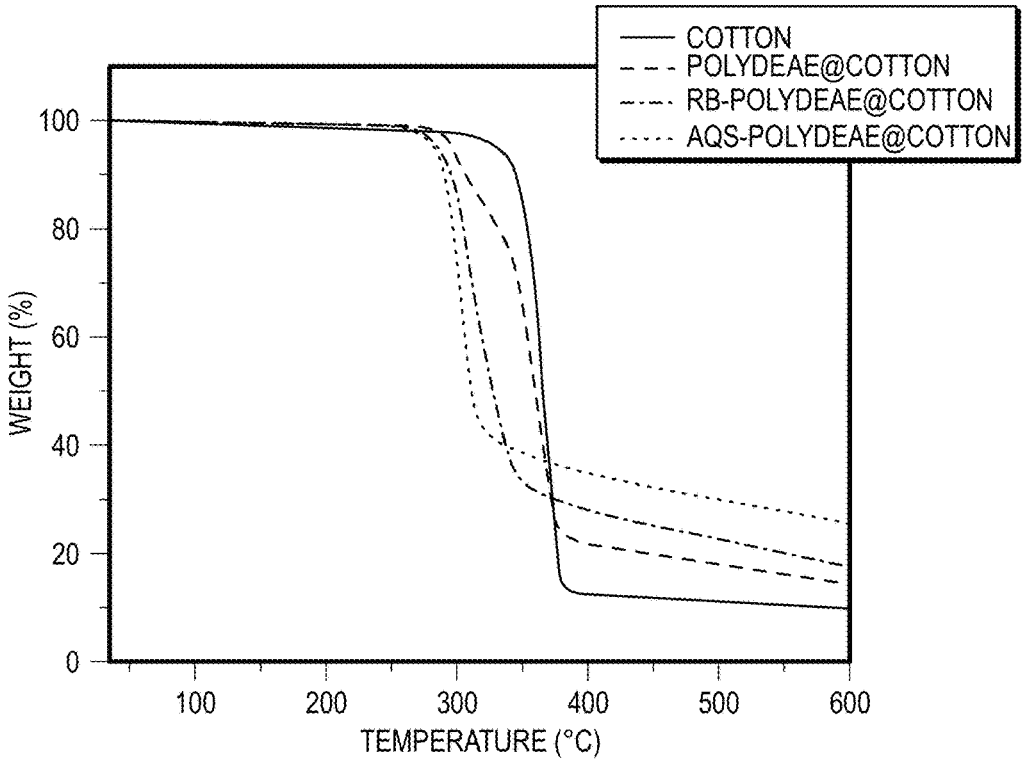
FIG. 6B illustrates TGA curves of cotton and PIFs.
Figure 7A:
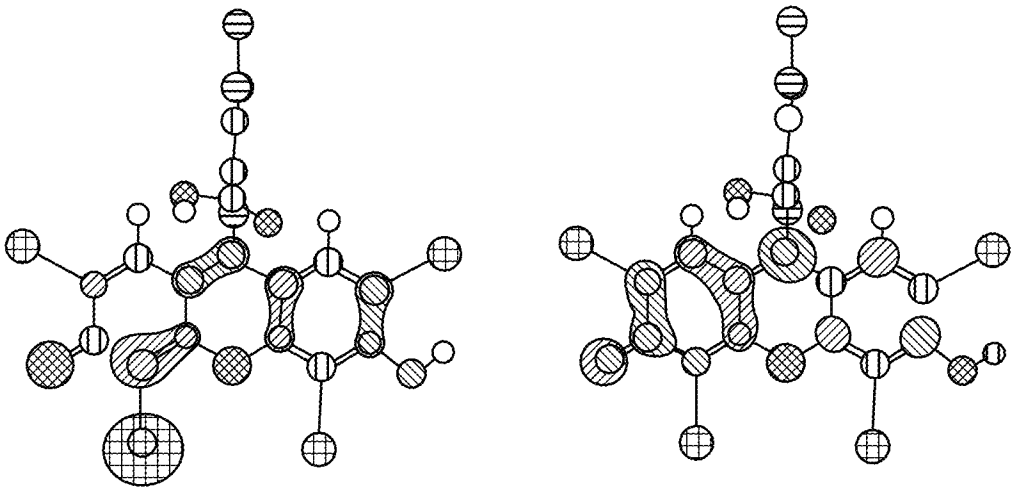
FIG. 7A illustrates molecular orbitals of Rose Bengal.
Figure 7B:
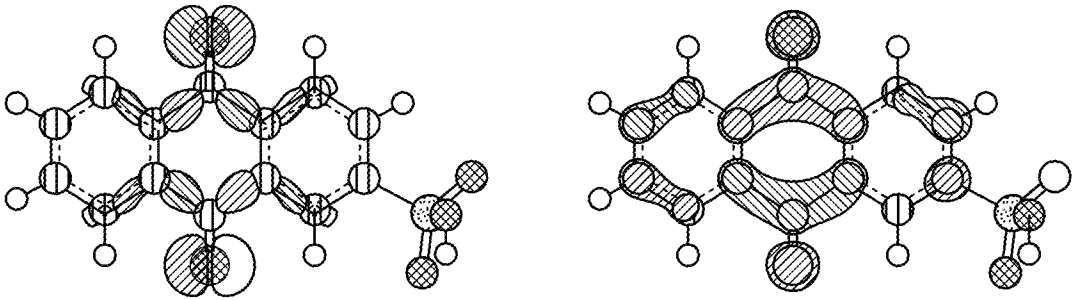
FIG. 7B illustrates molecular orbitals of AQS.
Figure 7C:
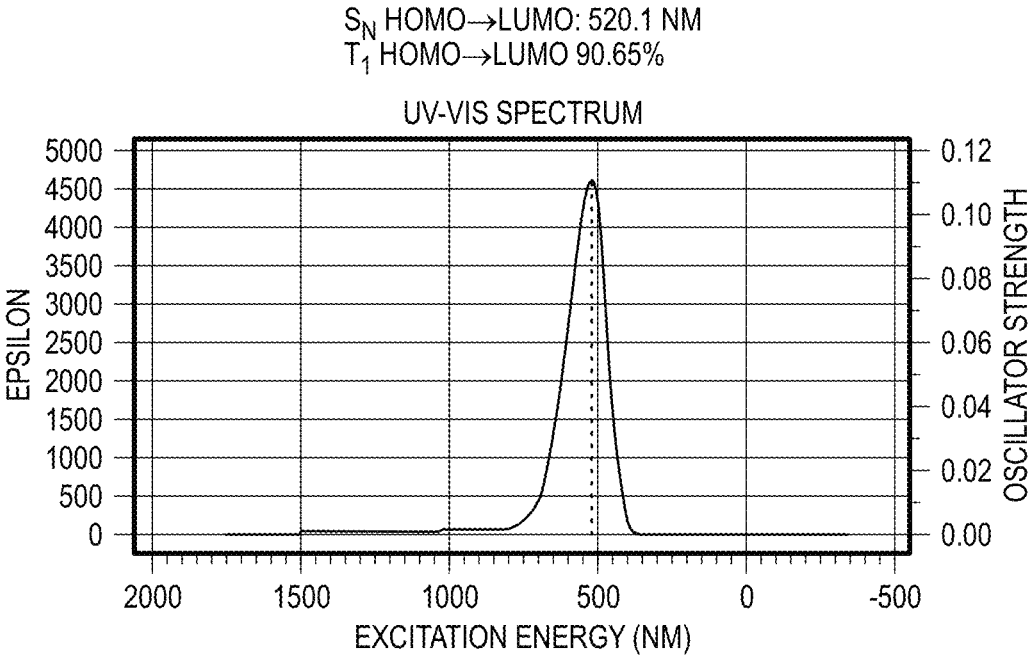
FIG. 7C illustrates a calculated UV-vis spectra of Rose Bengal.
Figure 7D:
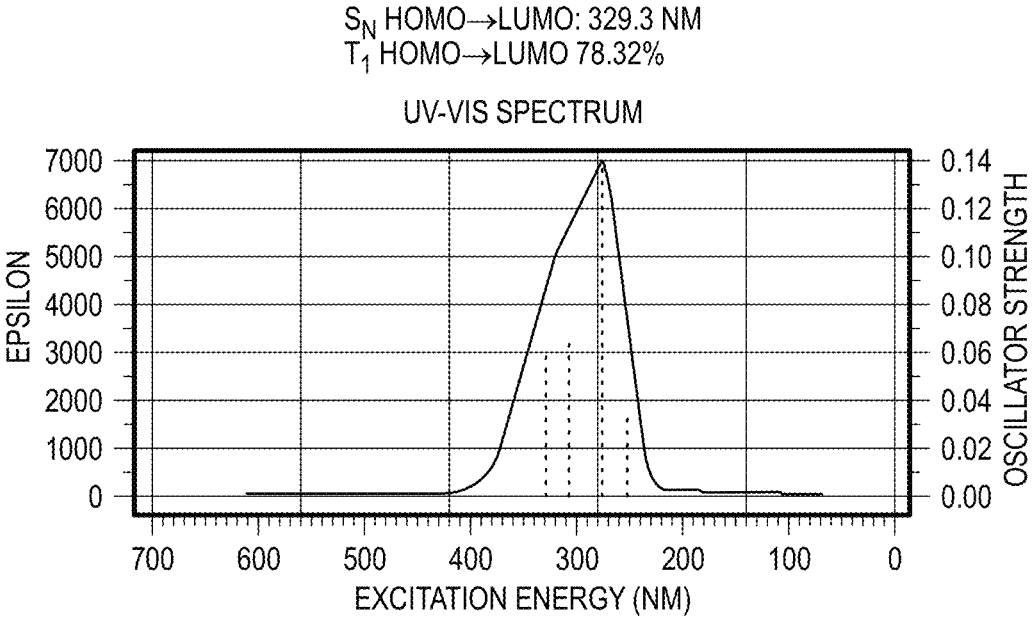
FIG. 7D illustrates a calculated UV-vis spectra of AQS.
Figure 8A:
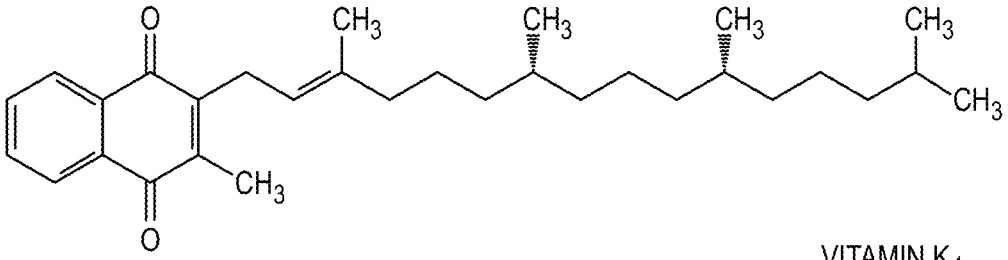
FIG. 8A illustrates chemical structures of Vitamin $K_1$($VK_1$), $VK_3$, and $VK_4$.
Figure 8A:
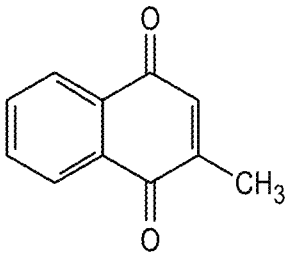
Figure 8A:
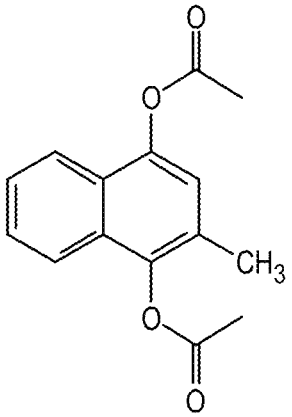
Figure 8B:
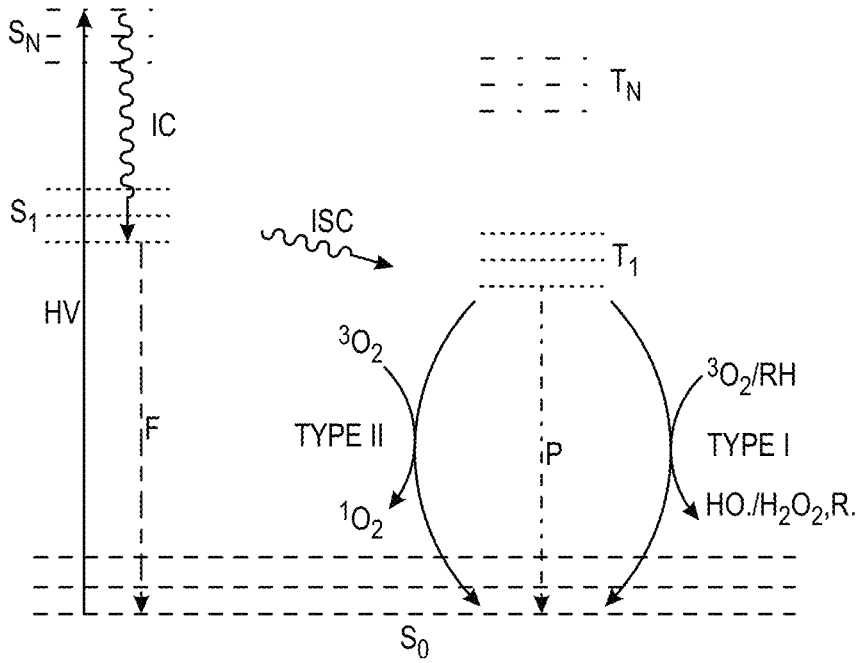
FIG. 8B illustrates Jablonski diagrams of the physical excitation process and following chemical photoreactions.
Figure 8C:
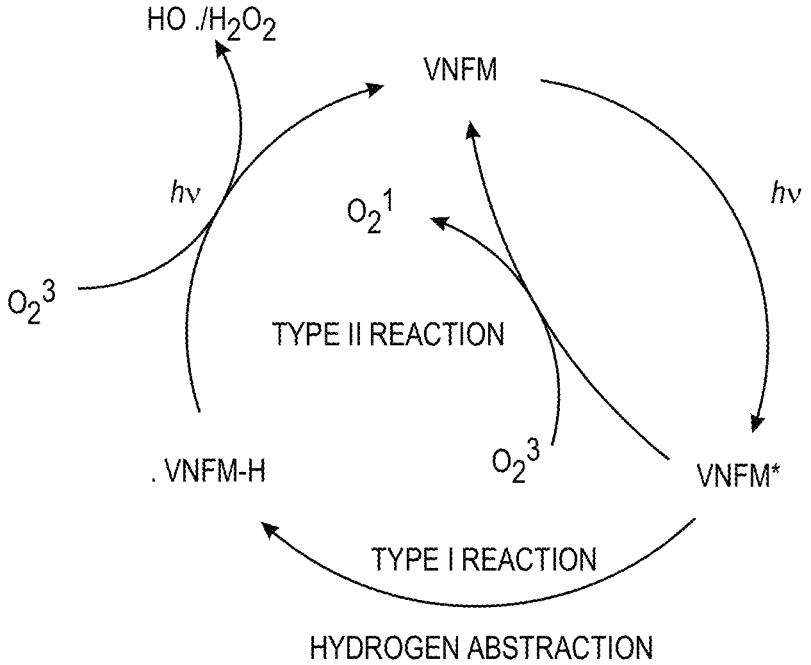
FIG. 8C illustrates mechanism for the photo-induced ROS generation cycle.
Figure 8D:
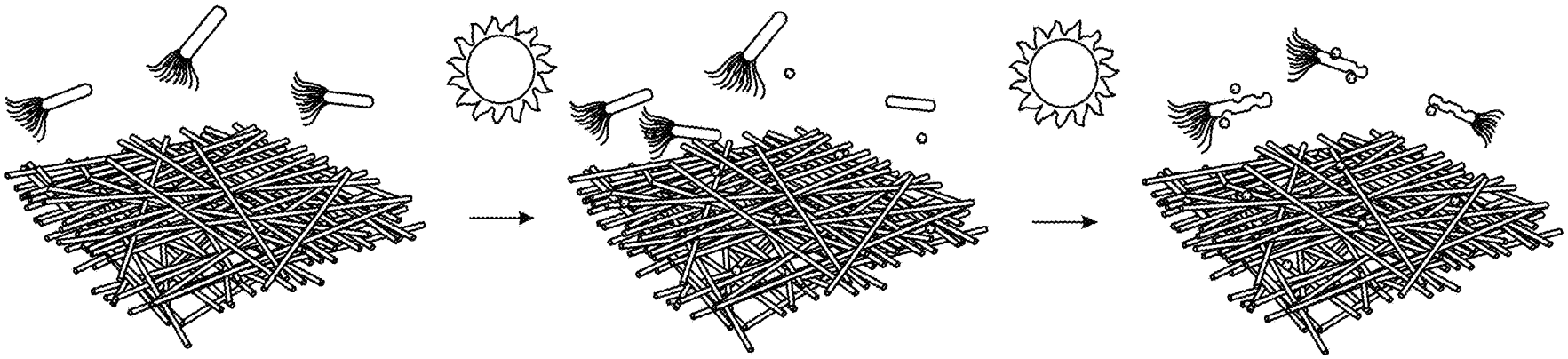
FIG. 8D illustrates schematic illustration of photoactivated biocidal function of VK containing nanofibrous membranes.
Figure 9A:
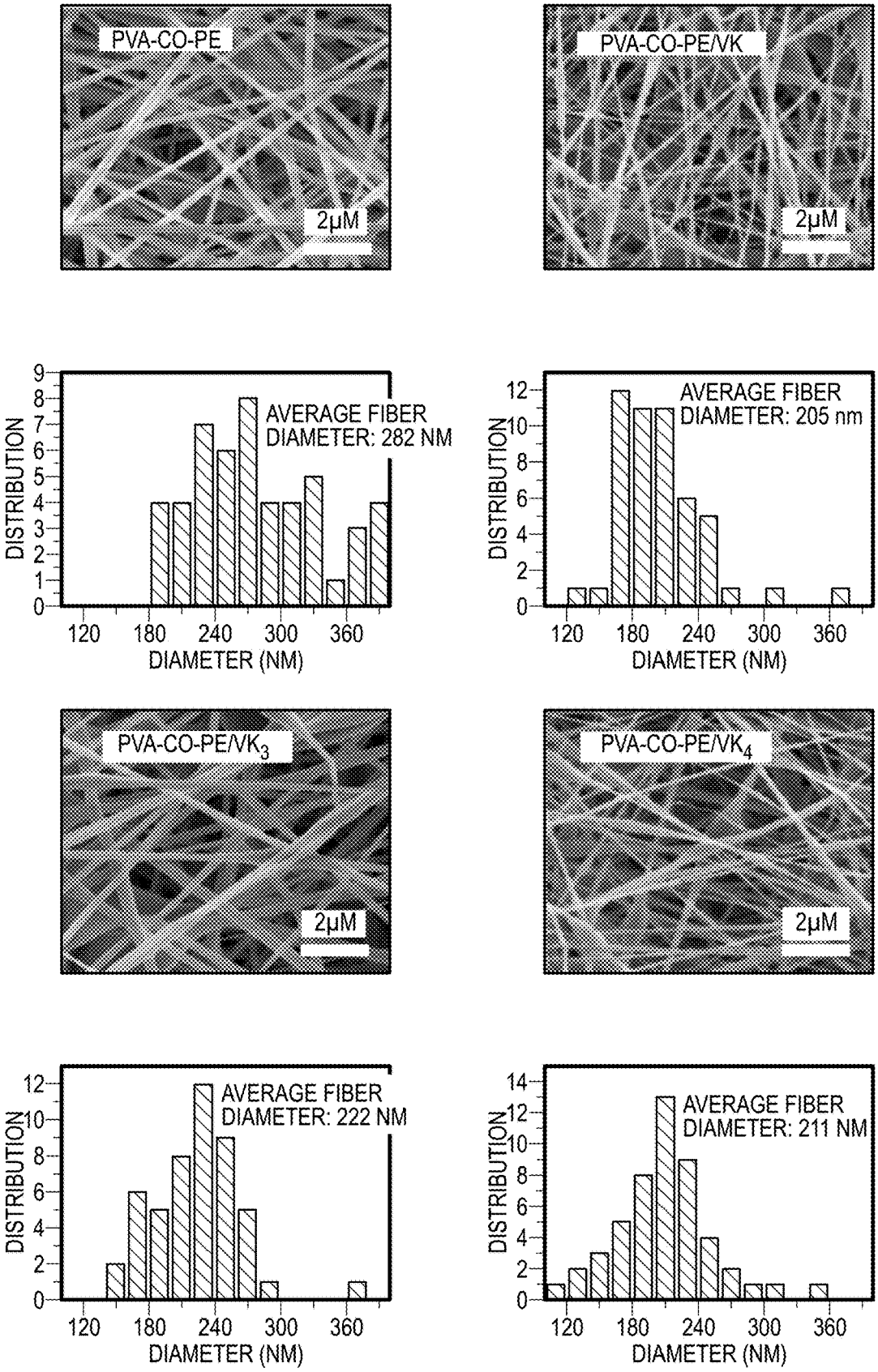
FIG. 9A illustrates micro-structures and fiber diameter statistics of PVA-co-PE/vitamin K nanofibrous membranes.
Figure 9B:
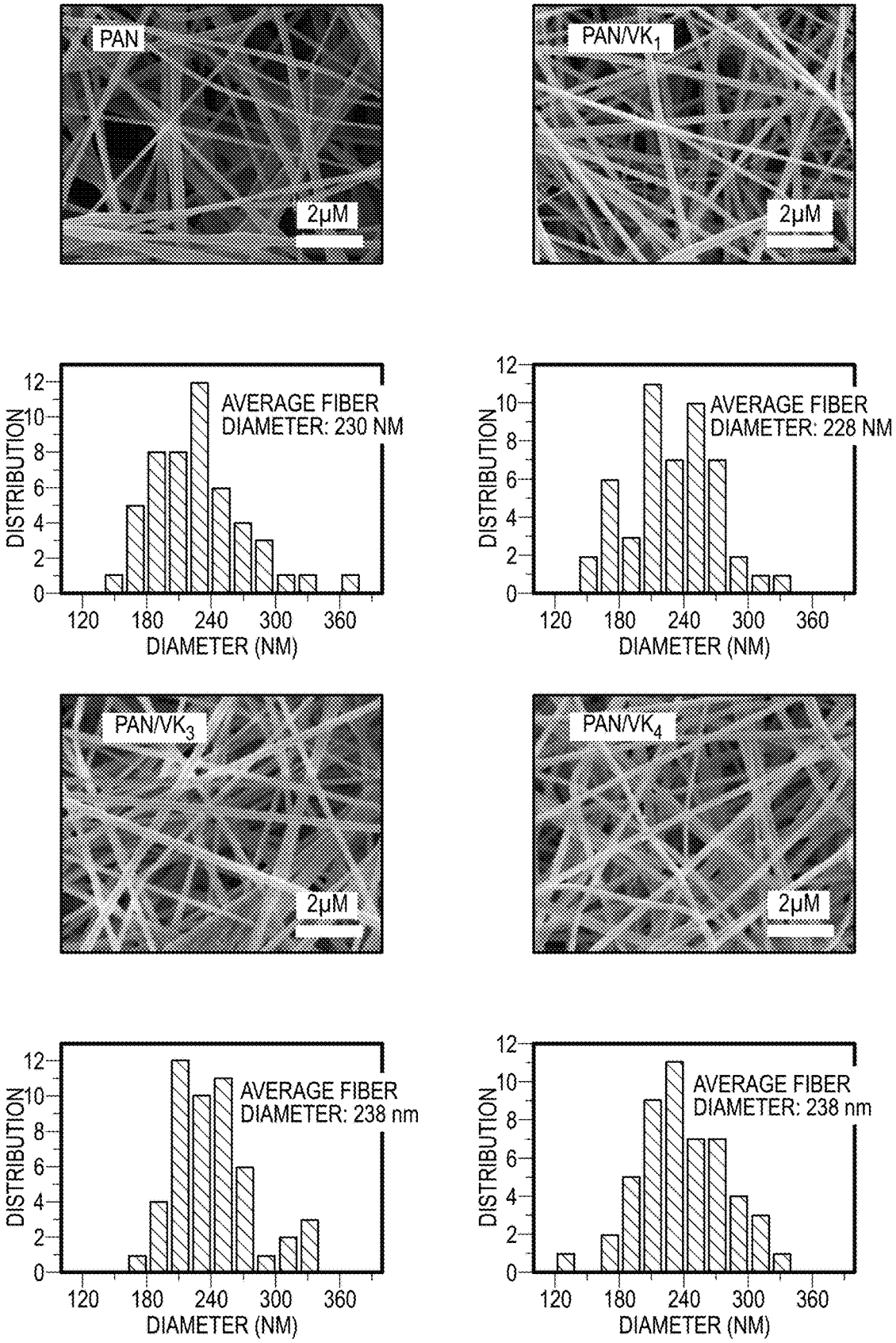
FIG. 9B illustrates micro-structures and fiber diameter statistics of PAN/vitamin K nanofibrous membranes.
Figure 10A:
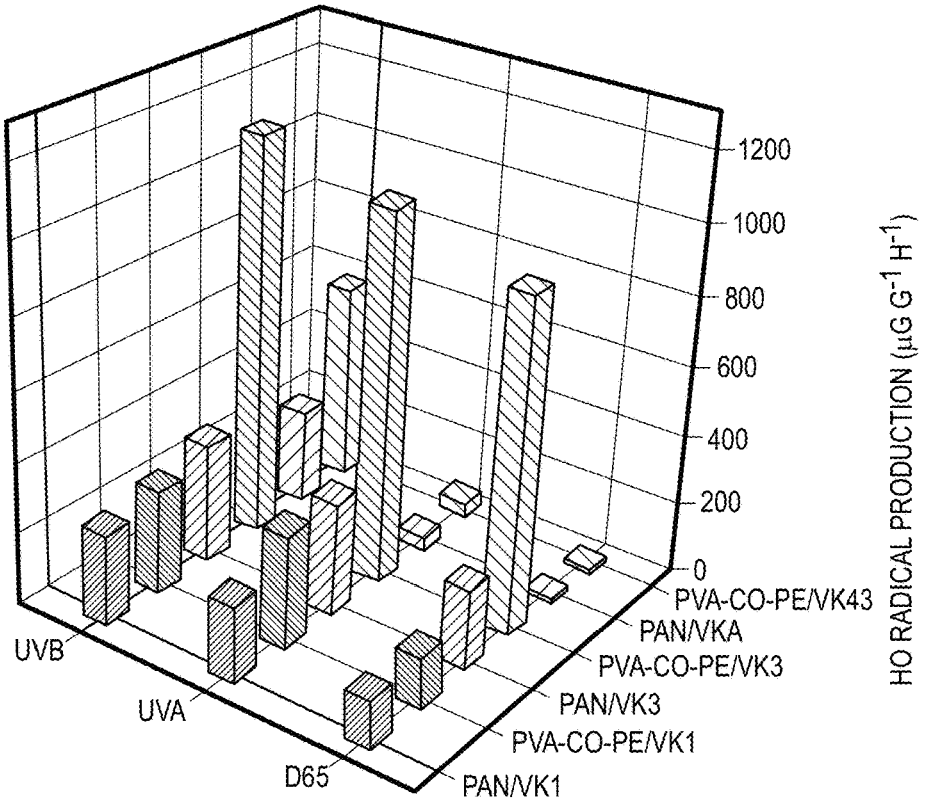
FIG. 10A illustrates hydroxyl radical production of various VK containing nanofibrous membranes under photoirradiation.
Figure 10B:
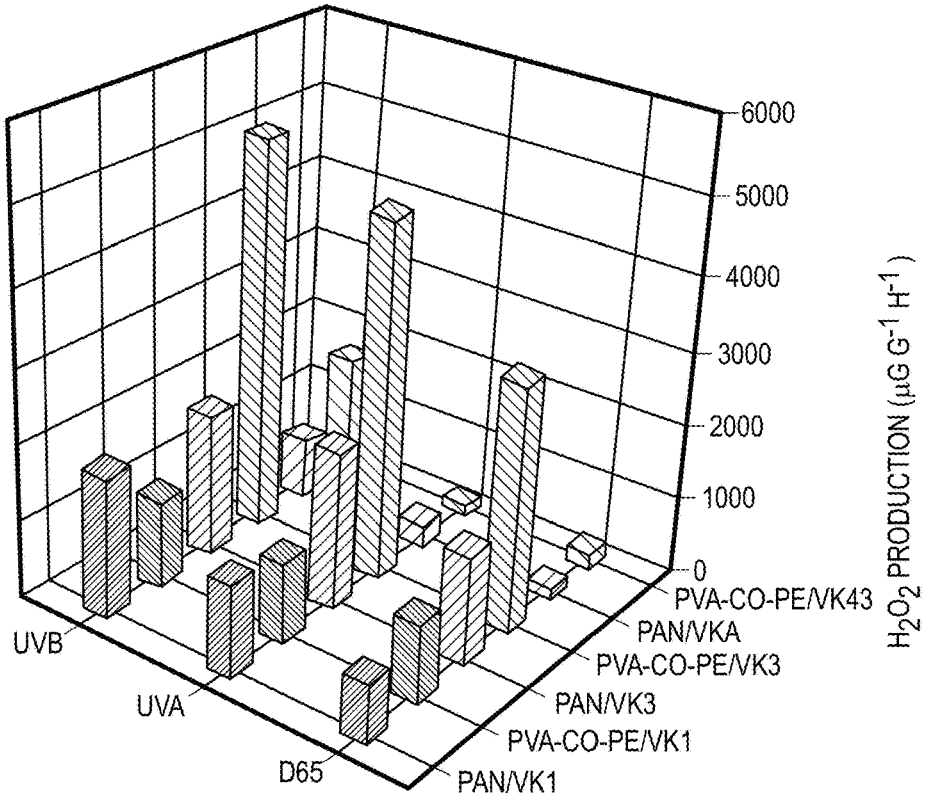
FIG. 10B illustrates hydrogen peroxide production of various VK containing nanofibrous membranes under photoirradiation.
Figure 10C:
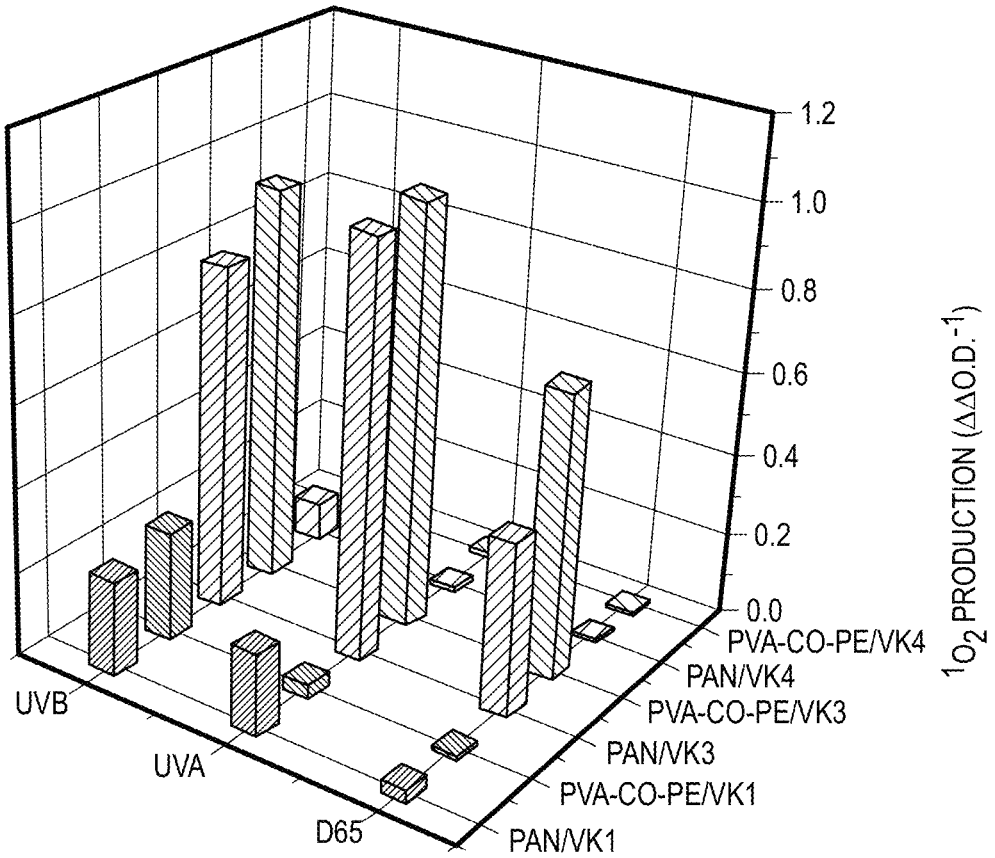
FIG. 10C illustrates singlet oxygen production of various VK containing nanofibrous membranes under photoirradiation.
Figure 10D:
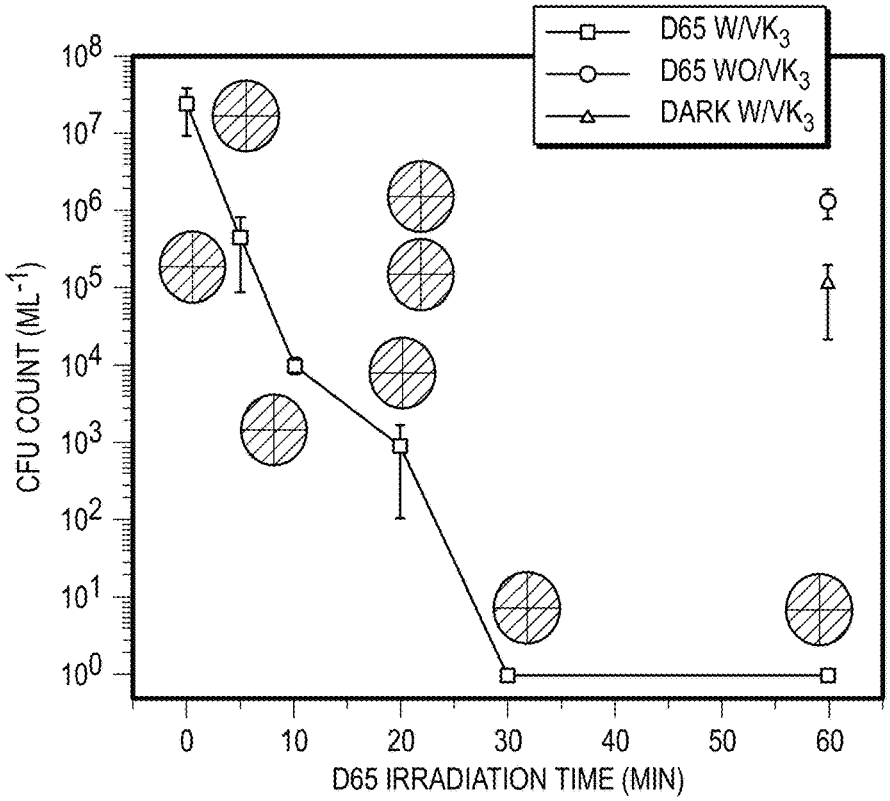
FIG. 10D illustrates daylight (D65)-induced time-dependent antimicrobial performance of PVA-co-PE/$VK_3$ against *E. coli*.
Figure 10E:
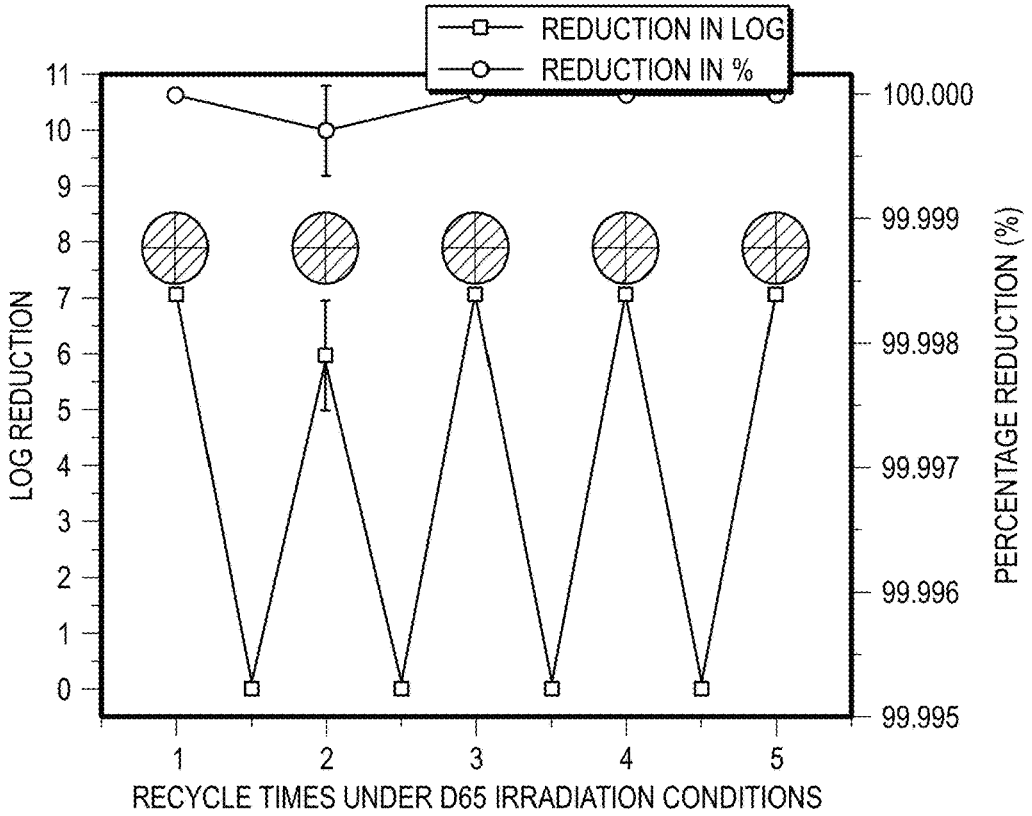
FIG. 10E illustrates daylight-induced antimicrobial durability performance of PVA-co-PE/$VK_3$ against *E. coli*.
Figure 10F:
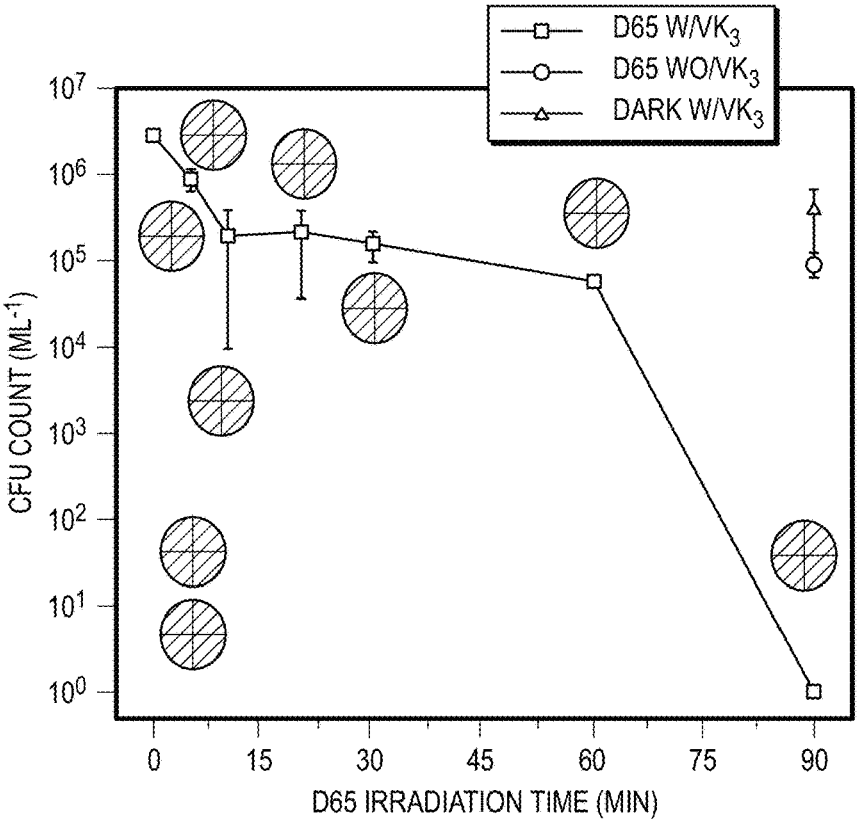
FIG. 10F illustrates daylight (D65)-induced time-dependent antimicrobial performance of PVA-co-PE/$VK_3$ against *L. innocua*.
Figure 10G:
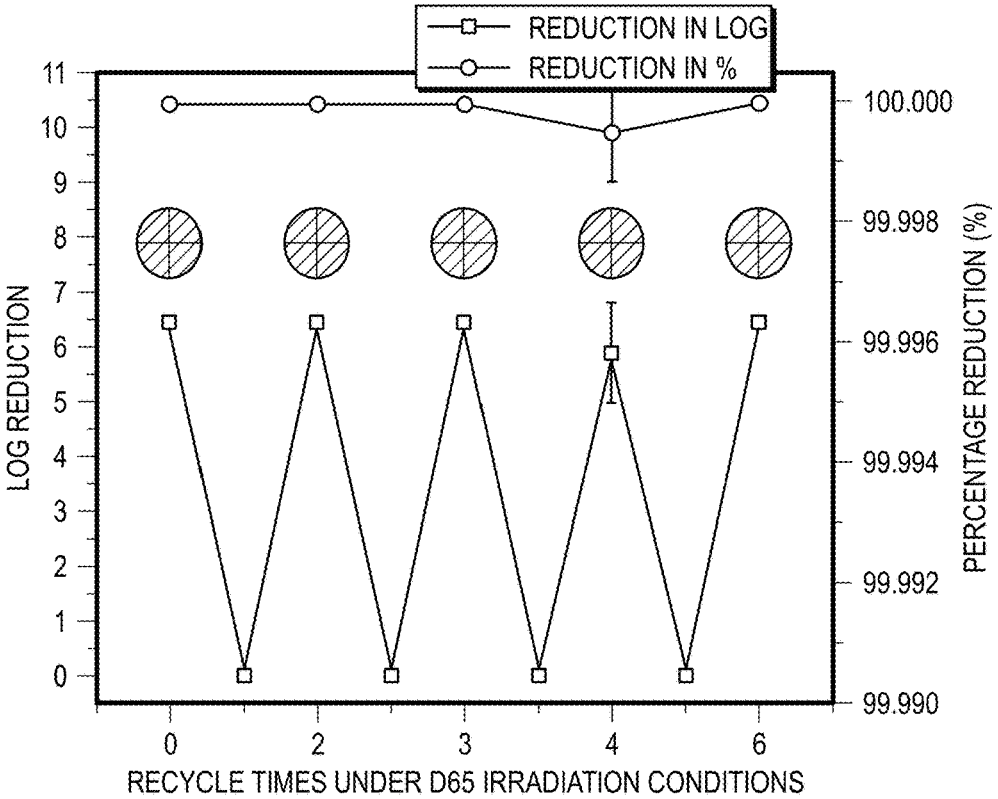
FIG. 10G illustrates daylight-induced antimicrobial durability performance of PVA-co-PE/$VK_3$ against *L. innocua*.
Figure 10H:
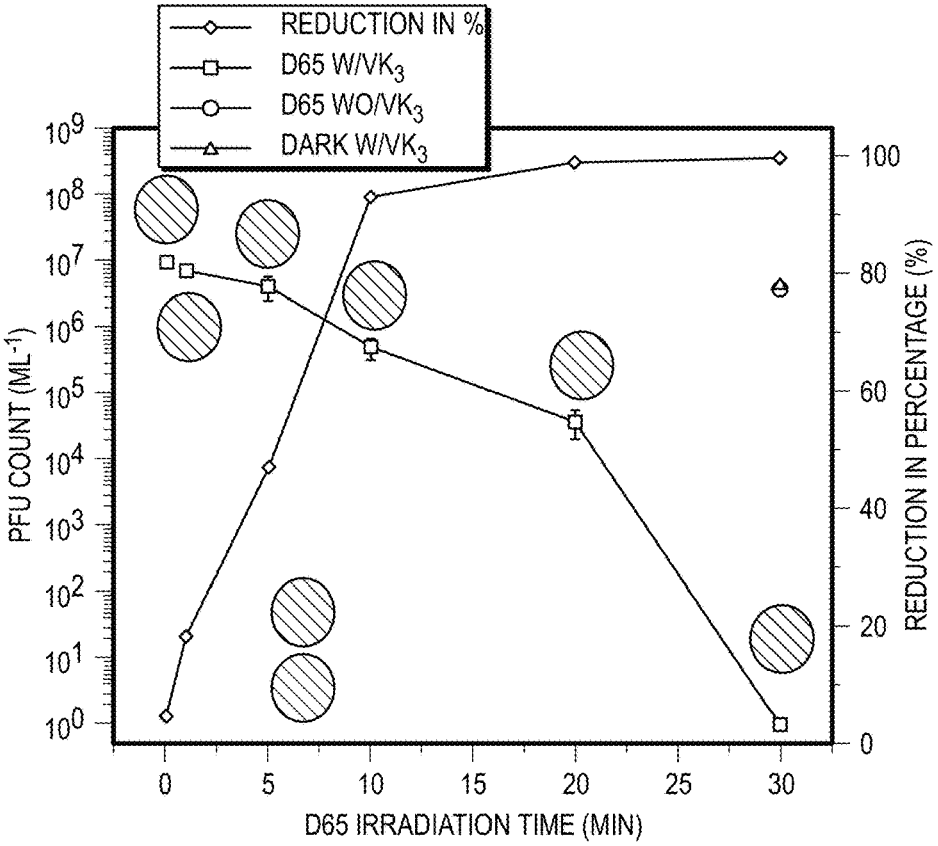
FIG. 10H illustrates daylight (D65)-induced time-dependent antimicrobial performance of PVA-co-PE/$VK_3$ against T7 bacteriophage.
Figure 10I:
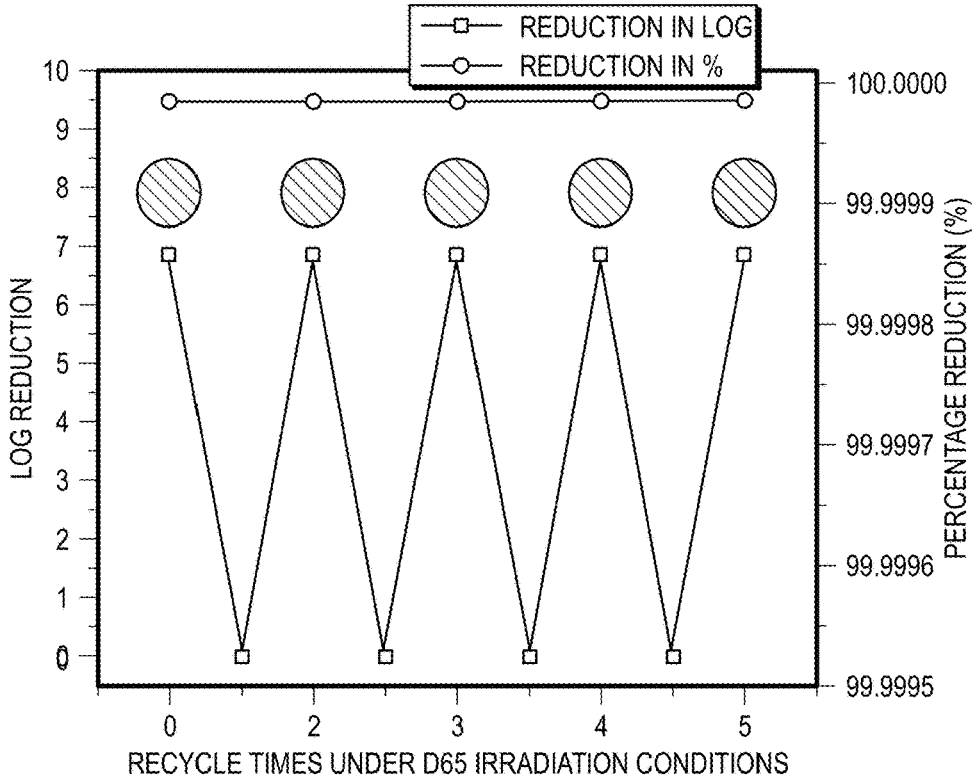
FIG. 10I illustrates daylight-induced antimicrobial durability performance of PVA-co-PE/$VK_3$ against T7 bacteriophage.
Figures 11A, 11B:
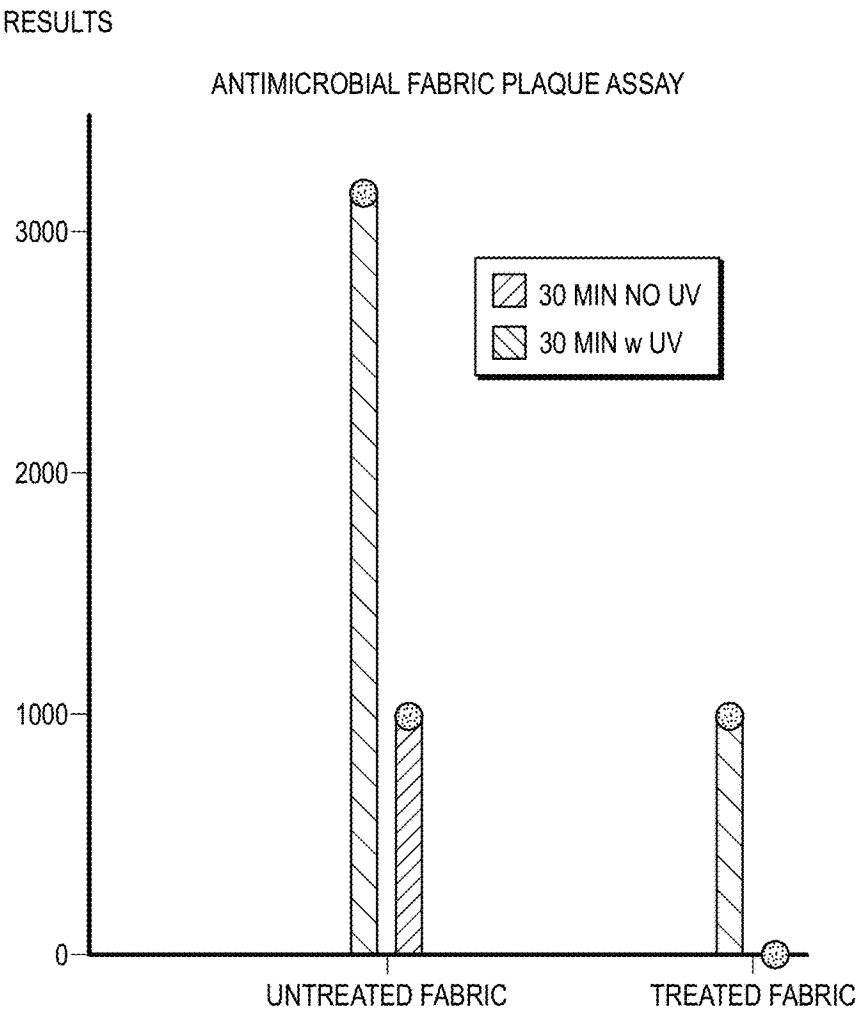
FIG. 11A illustrates antimicrobial fabric plaque assay.
FIG. 11B illustrates antimicrobial fabric plaque assay.
Figure 12:
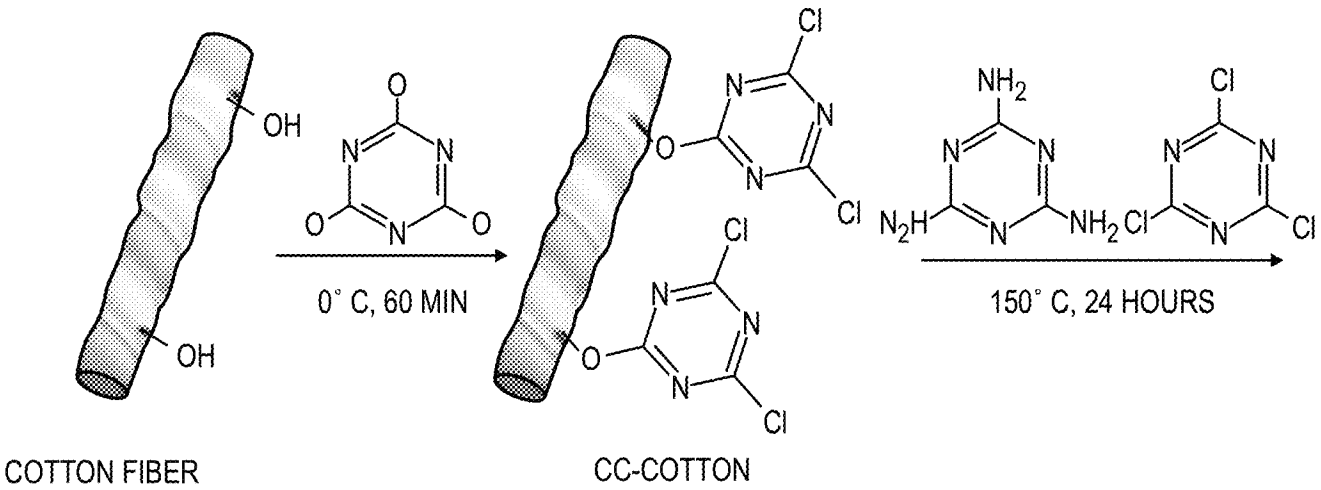
FIG. 12 illustrates a fabrication process of SAFE-Cotton and DBwEE-Cotton.
Figure 12:
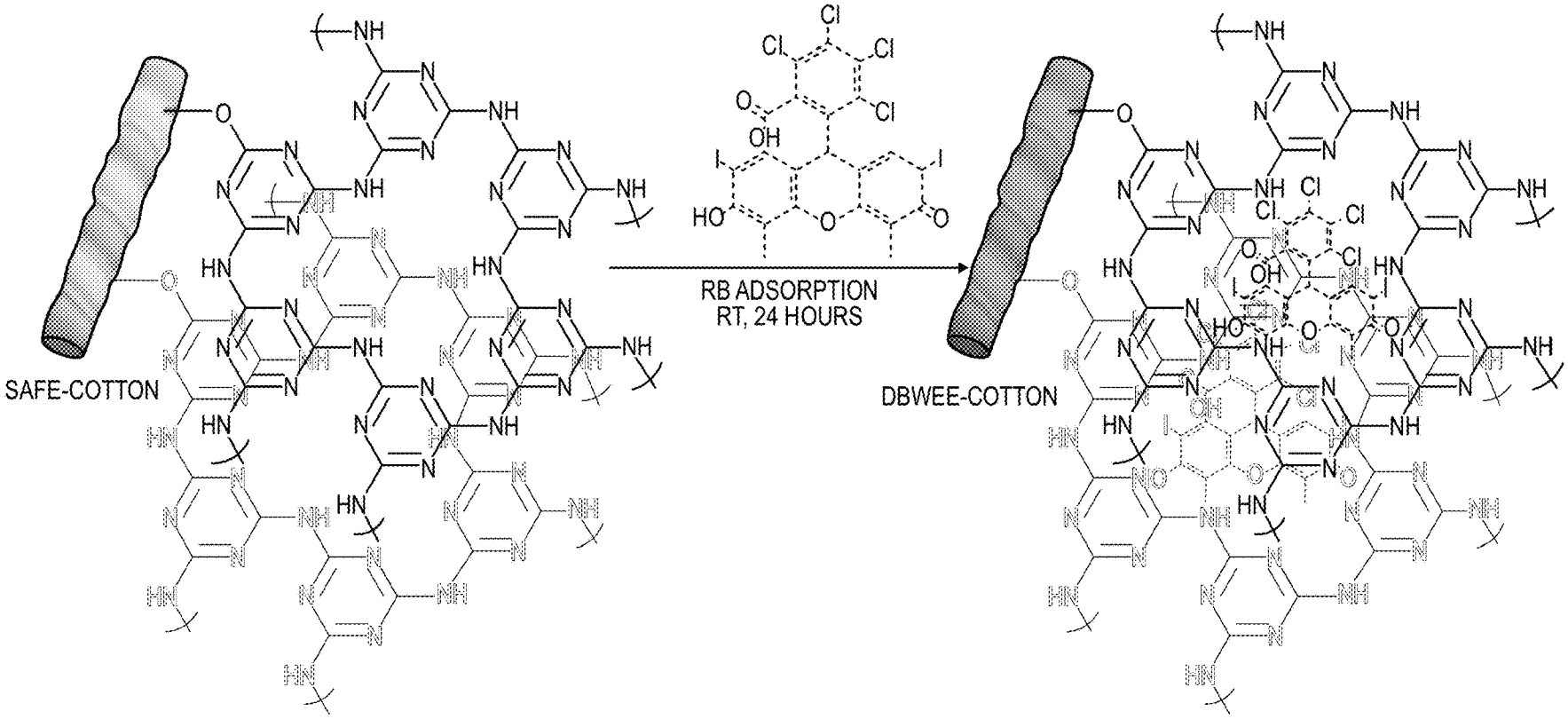

Then, the functionalization of polyDEAE@cotton by PS through electrostatic chemisorption is illustrated in FIG. 1A. The surface morphology of the cotton after different treatments were examined under SEM (FIGS. 1B-1E). There is no obvious surface morphology change of the cotton fibers after polyDEAE growth, indicating that the size of the polyDEAE short chains still lied in a molecular level. Similarly, no significant morphology change of the cotton fibers was noticed under SEM after PS functionalization. In spite of this, the chemical structures and component variations of the PIFs were confirmed through FTIR and TGA (FIGS. 6A and 6B).

In certain aspects, the anionic photosensitizer can be applied to the fabric at a concentration of about 10 mg/L to 1000 mg/L of anionic dye in a water bath. Photosensitizer solutions can be prepared by dissolving a specific amount of the anionic dye in deionized water, which bath can be used as a dyeing solution. A fabric to PS solution ratio (liquor ratio) can be at a ratio of about 1:25-100, or about 1:50. The solution pH is adjusted to about 5.0 to about 8.0 such as 5.5 to 7.0, or about 6.0 to 6.5 or about 6.0 with dilute acid (e.g. 0.1 M HC) solution. In certain aspects, the amount of dye per fabric w/w is about 1 mg/g to about 100 mg/g, or about 15 to about 50 mg/g, or about 20 to about 35 mg/g.

Figure 1F:
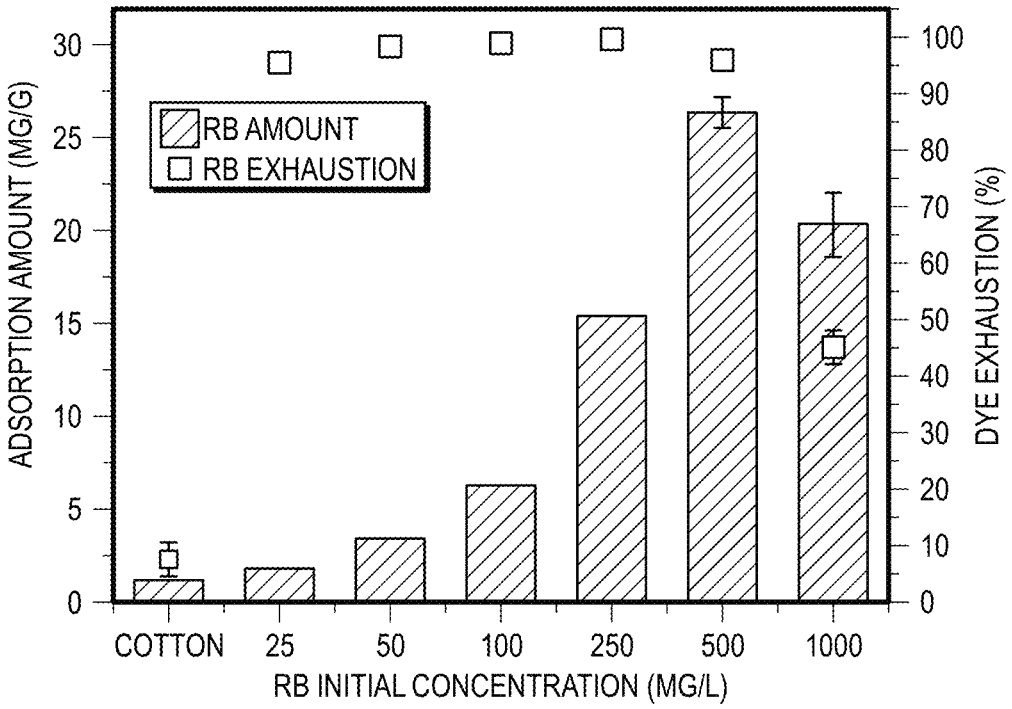
FIG. 1F illustrates adsorption amount and dye exhaustion of RB.

In certain aspects, the antibacterial and antiviral functions of PIFs are provided by the incorporated anionic PSs on the polyDEAE@cotton, a result of strong electrostatic interactions between two ionic groups with opposite charges. (Tang, P.; Zhang, M.; Robinson, H.; Sun, G. Fabrication of Robust Functional Poly-Cationic Nanodots on Surfaces of Nucleophilic Nanofibrous Membrane. *Appl. Surf Sci.* 2020, 528, 146587.) Different initial concentrations of RB and 2-AQS were applied to examine the attractive static interactions with the cationic or polycationic short chains on the polyDEAE@cotton. As shown in FIG. 1F, the RB adsorbed on the polyDEAE@cotton increased, as the initial concentration of RB was increased from 25 mg/L to 500 mg/L, and became steady if the RB concentration was further increased to 1000 mg/L. From the calculated dye exhaustion in FIG. 1F, more than 95% of the RB in solution (initial concentration ranging from 25 mg/L to 500 mg/L) were attracted onto the polyDEAE@cotton after 40 min dyeing process, whereas the dye exhaustion rate dropped to around 45.0% when the RB concentration reached 1000 mg/L. A similar phenomenon can be noticed for the use of 2-AQS as a PS, as presented in FIG. 1G. The 2-AQS exhaustions by the polyDEAE@cotton were tested as >95%, when the initial 2-AQS concentration was below or at 500 mg/L, then dropped to 43.6% when the concentration reached 1000 mg/L, due to saturation of adsorption of the anionic molecule.

Figure 1G:
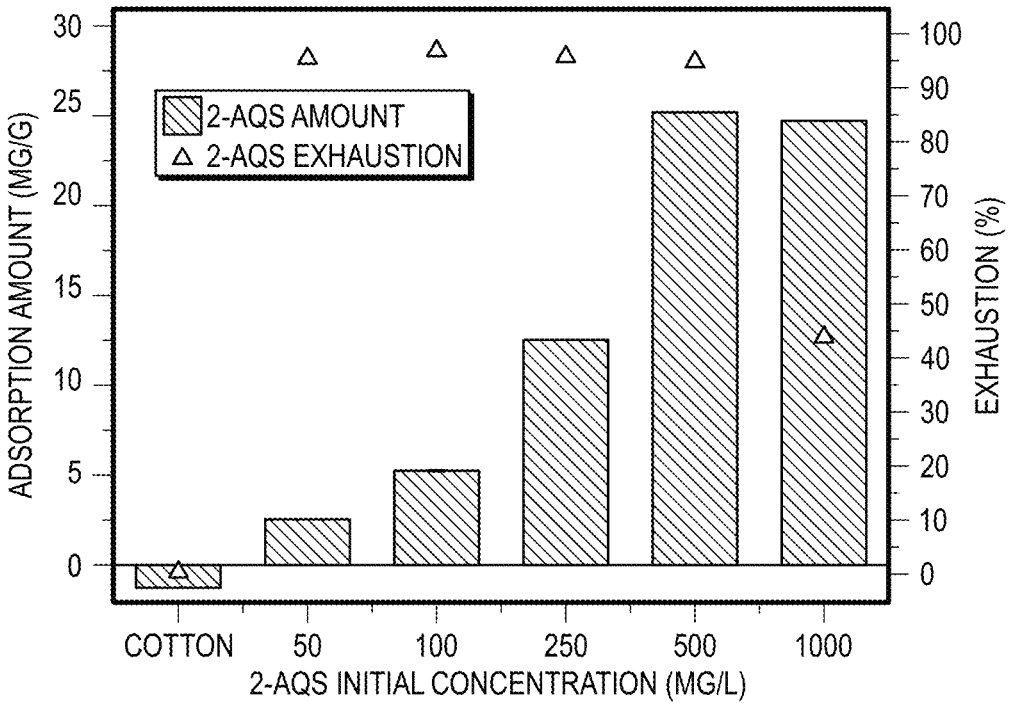
FIG. 1G illustrates 2-AQS on polyDEAE@cotton with different initial concentrations. The "cotton" in the x-axis means pristine cotton dyed with 250 mg/L RB or 2-AQS.
Figure 1H:
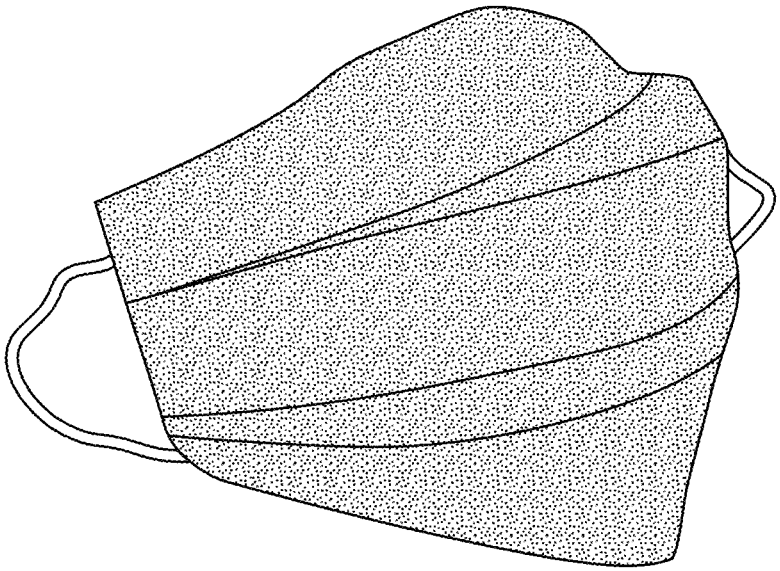
FIG. 1H illustrates a design of face mask based on PIFs.
Figure 1I:
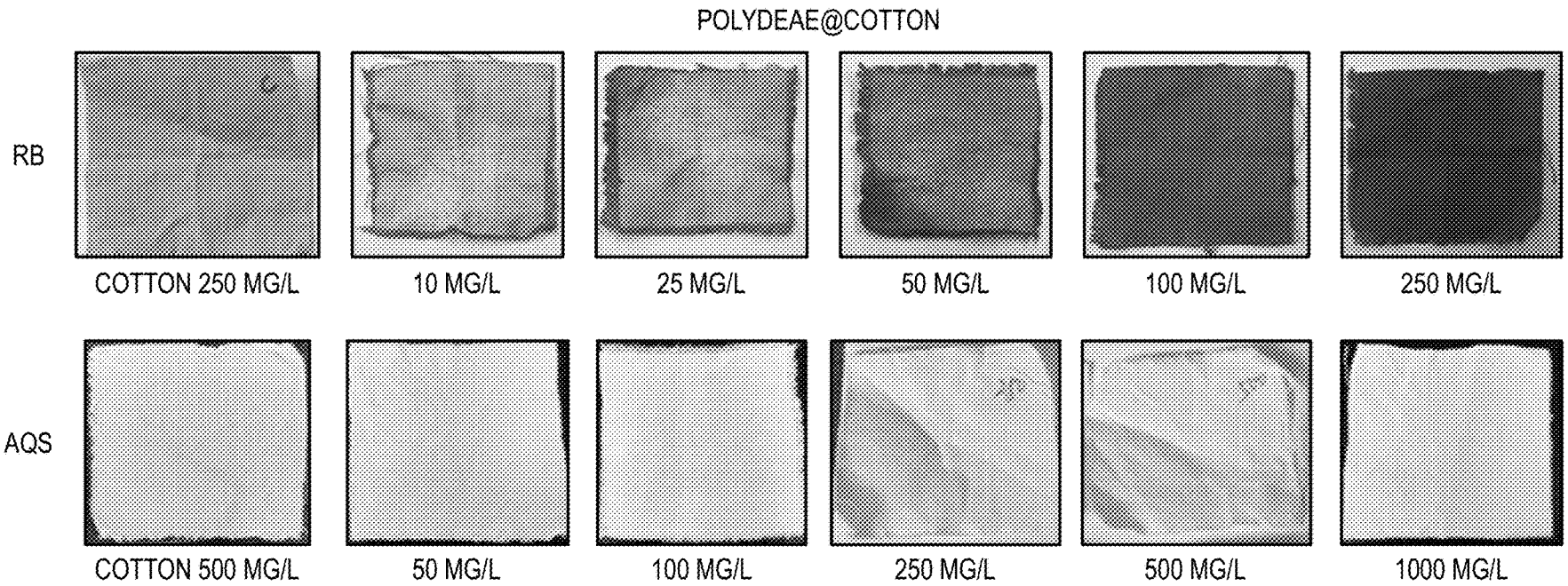
FIG. 1I illustrates optical images of PIFs functionalized by different initial concentrations of RB and AQS.

In certain aspects, the presence of cationic or polycationic short chains on the polyDEAE@cotton is beneficial for ensuring the biocidal functions by having sufficient amounts of PSs on the PIFs. The highest adsorption amounts of both RB and 2-AQS on the polyDEAE@cotton were found at 26.28 mg/g and 25.16 mg/g, respectively. In contrast, the pristine cotton only showcased 1.09 mg/g of RB adsorption and no affinity to 2-AQS at the PS initial concentration of 500 mg/L (FIGS. 1F and 1G). The optical images of the PIFs and a demo of using PIF for face mask design are shown in FIG. 1I and FIG. 1H, respectively. The growth of the polyDEAE on the cotton fibers leads to high exhaustion of PSs by the polyDEAE@cotton, making the fabrication of PIFs efficient, green, and environmentally friendly by reducing residual PS in the wastewater.

Figure 2A:
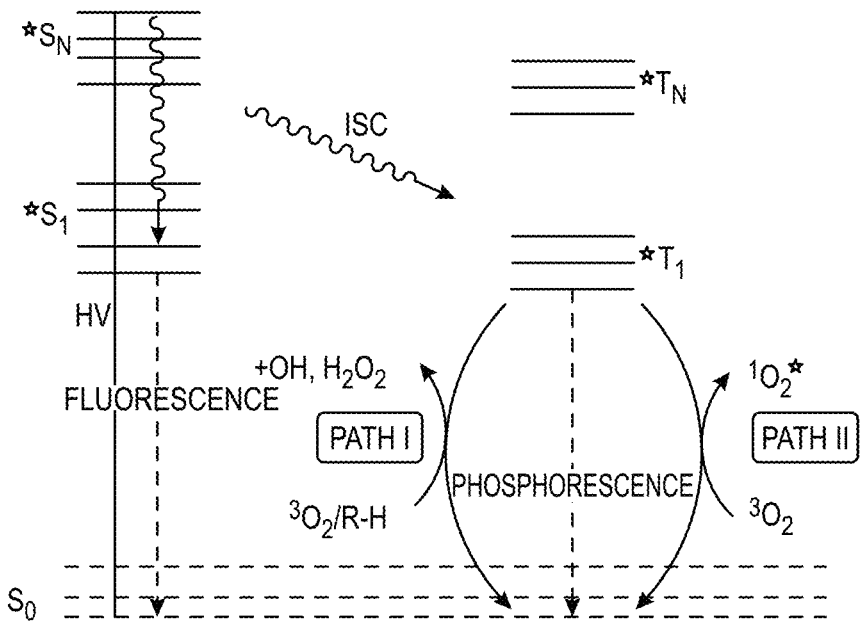
FIG. 2A illustrates Jablonski diagrams illustrating the daylight excitation of a photosensitizer to singlet state and following intersystem crossing to the triplet state, finally performing the generation of ROS via path I and path II mechanisms.
Figure 2B:
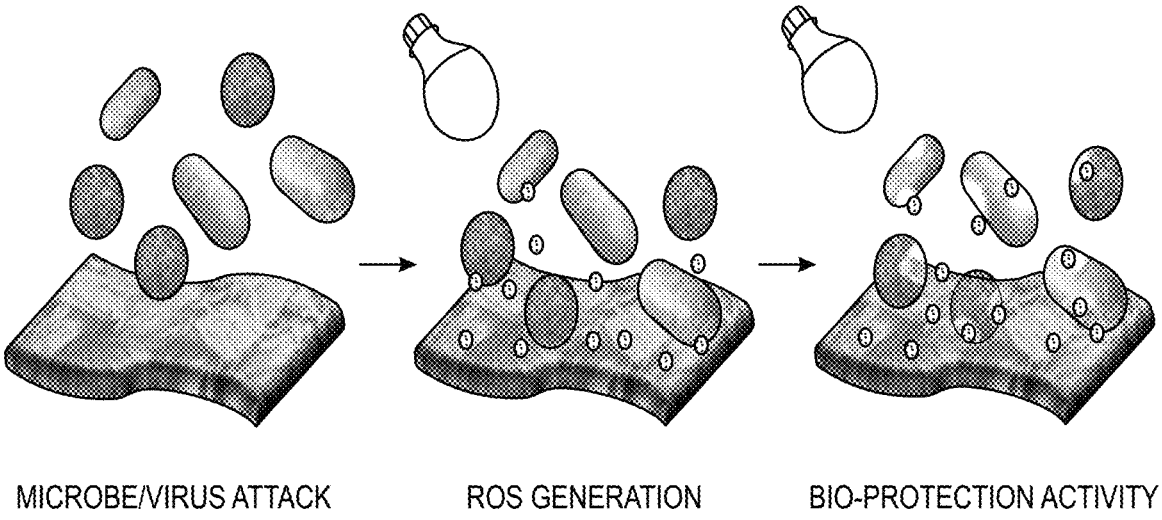
FIG. 2B illustrates scheme of the daylight-induced functions of PIFs.

In certain aspects, the generation of ROS on the PIFs under daylight represent desired biocidal functions against both bacteria and viruses. (Wiehe, A.; O'brien, J. M.; Senge, M. O. Trends and Targets in Antiviral Phototherapy. *Photochem. Photobiol. Sci.* 2019, 18 (11), 2565-2612.) The specific mechanism of ROS generation from PSs under light can be explained by the Jablonski diagram illustrated in FIG. 2A. The achievement of the triplet excited state ($^*T_n$) of the PS through intersystem crossing is essential for generating ROS, including hydroxyl radical (·OH), superoxide radical ($\cdot O^{2-}$), hydrogen peroxide ($H_2O_2$), and singlet oxygen ($^1O_2$), in the presence of oxygen, which consequently perform biocidal functions. The generated ROS are strong oxidants, which can damage DNA, RNA, proteins, and lipids of microorganisms, contributing to the antibacterial and antiviral functions. (Fang, F. C. Antimicrobial Reactive Oxygen and Nitrogen Species: Concepts and Controversies. *Nature Reviews Microbiology.* 2004, pp 820-832; Pan, X.; Zhou, G.; Wu, J.; Bian, G.; Lu, P.; Raikhel, A. S.; Xi, Z. Wolbachia Induces Reactive Oxygen Species (ROS)-Dependent Activation of the Toll Pathway to Control Dengue Virus in the Mosquito Aedes Aegypti. *Proc. Natl. Acad. Sci. U.S.A* 2012, 109 (1), E23-E31.) FIG. 2B showcases the diagrammatic illustration of biocidal functions of the PIFs under daylight exposure. Once the pathogens are attached on the surface of the PIFs, the light-induced ROS could instantly kill the bacteria or viruses.

Figure 2C:
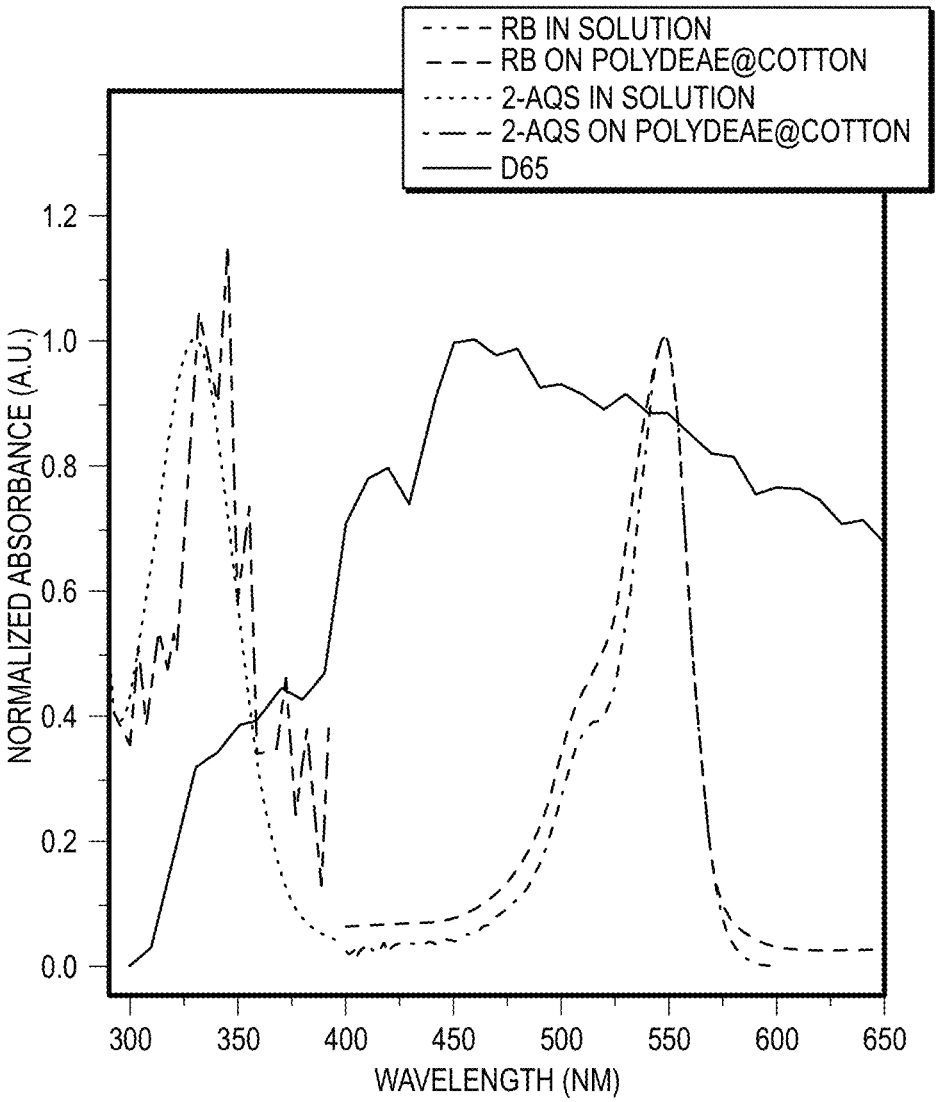
FIG. 2C illustrates normalized UV-vis spectra of RB and 2-AQS aqueous solutions and adsorbed on the polyDEAE@cotton accompanied with the spectrum of D65 standard light source.

In certain aspects, to gain an insight on the photoexcitation process of PS on PIFs, we used time-dependent density functional theory (TD-DFT) calculations to evaluate the photoactivity of RB and 2-AQS. The required energy for triggering the excitation from the ground state of the PS to its singlet excited state can be visually examined through the UV-vis adsorption spectrum of the PS. As shown in FIG. 2C, the maximum absorption wavelength ($\lambda_{max}$) of 2-AQS and RB appears at 330 nm and 550 nm, respectively. Given that the light absorption of RB completely lies in the visible range, the ROS production from the RB excitation under daylight is expected to be efficient. Although the $\lambda_{max}$ of 2-AQS showcases in the UV range, the light energy provided by D65 standard light source ranging from 300 nm to 400 nm can still trigger the photoexcitation (FIG. 2C).

In certain aspects, the presence of anionic carboxylate in RB and sulfonate groups in 2-AQS structures makes them attractive to the cationic or polycationic short chains on the polyDEAE@cotton, leading to an easy functionalization of cotton cloth with photo-induced antibacterial and antiviral properties. Nevertheless, the photoactivity of PSs after the formation of the electrostatic pairs with polyDEAE@cotton was investigated. As presented in FIG. 2C, the $\lambda_{max}$ of RB and 2-AQS on the polyDEAE@cotton shows a negligible difference to that of the PS in aqueous solution, illustrating no influence on the energy requirement of photoexcitation. Meanwhile, according to TD-DFT calculation of RB and 2-AQS, neither the carboxylate nor the sulfonate orbital involved in the achievement of exited singlet and triplet states of the PSs (FIGS. 7A-7D). Since the photoactivity of RB and 2-AQS is excluded from their anionic groups, the adsorption of RB and 2-AQS on the polyDEAE@cotton based on electrostatic interaction would not disturb their photoexcitation process. Meanwhile, the RB- and 2-AQS-dyed PIFs showed similar absorption spectra to the free PSs (FIG. 2C), making the photoexcitation of PIFs identical to that of the PS in the water system.

Figure 2D:
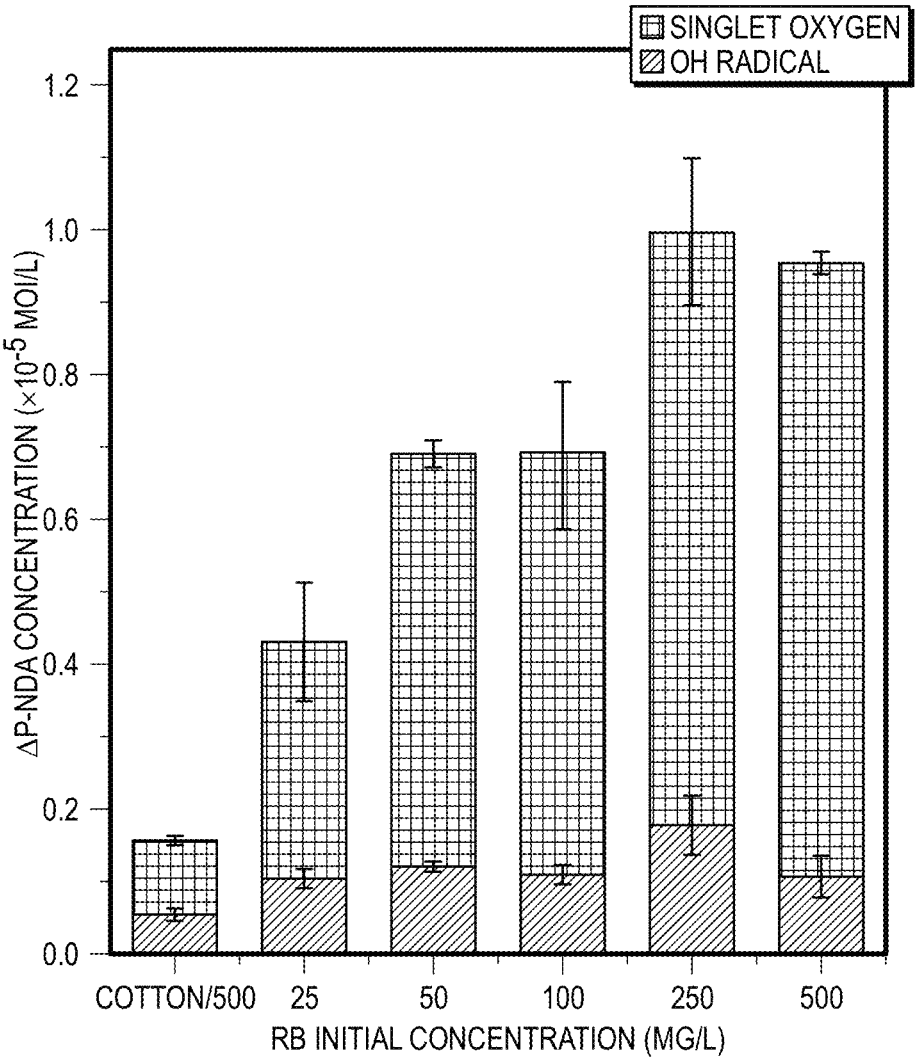
FIG. 2D illustrates measurement of ROS production from RB-polyDEAE@cotton.
Figure 2E:
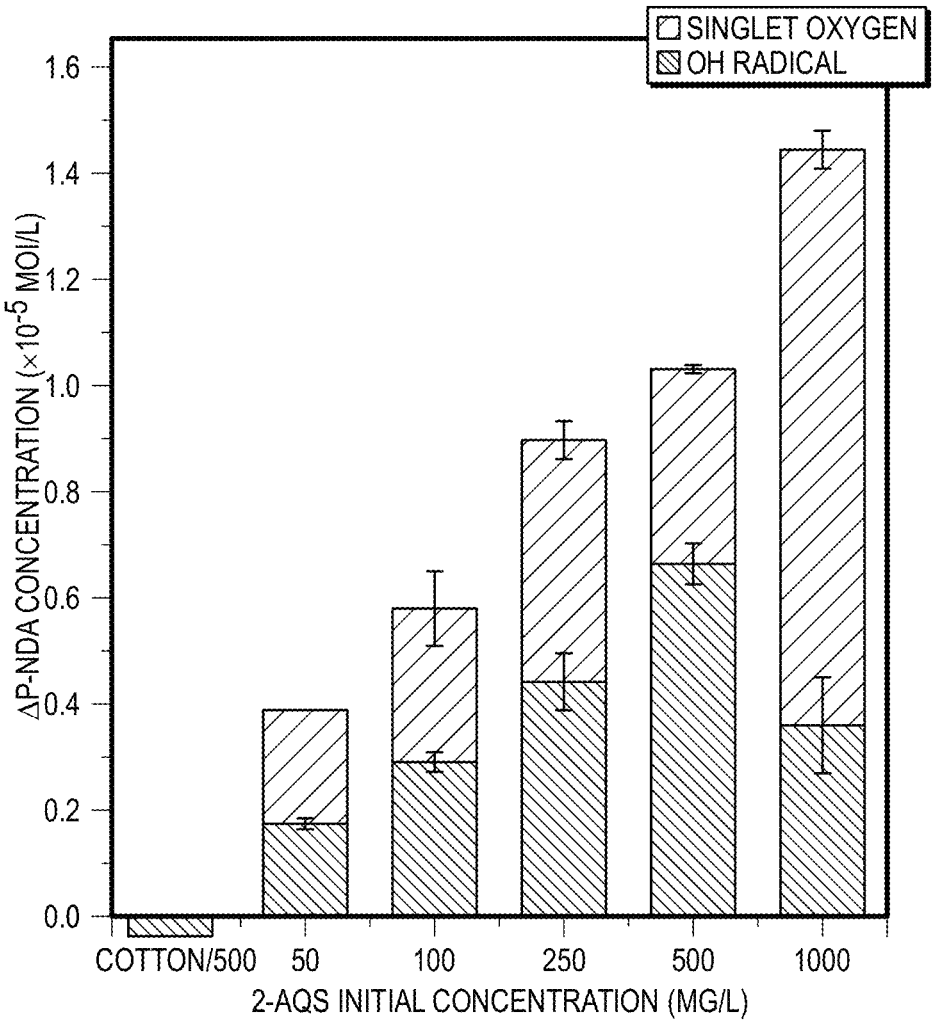
FIG. 2E illustrates 2-AQS-polyDEAE@cotton according to RB and 2-AQS initial concentrations under 30 min daylight illumination. The "Cotton/500" in the x-axis refers to the pristine cotton dyed with 500 mg/L RB and 500 mg/L 2-AQS solution, respectively.

In certain aspects, to evaluate the photoactivity of PIFs, the production of ROS by both RB- or 2-AQS-dyed polyDEAE@cotton, denoted as RB-polyDEAE@cotton or 2-AQS-polyDEAE@cotton, was examined with daylight illumination for 30 min (FIGS. 2D and 2E). Consistent with other studies, RB is a good producer of singlet oxygen ($^1O_2$) via path II photoreaction mechanism with a negligible amount of ·OH production. By increasing the initial concentrations of RB in the dyeing solution, the RB-polyDEAE@cotton produced more $^1O_2$, which is super oxidative but short lived. Nevertheless, only around $0.1\times 10^{-5}$ mol/L p-NDA was bleached by ·OH, a ROS produced as a result of photoreaction path I, indicating that RB molecules in the RB-polyDEAE@cotton still exclusively undergo the path II photoreaction. Alternatively, anthraquinones are a group of PSs performing both path I and path II mechanisms of ROS production. As presented in FIG. 2E, the amounts of generated ·OH and $^1O_2$ on the 2-AQS-polyDEAE@cotton samples were comparable except for the one dyed with 1000 mg/L 2-AQS. The total generation of ROS (e.g., ·OH and $^1O_2$) was increased as more 2-AQS incorporating on the surface of the polyDEAE@cotton, evidence that the self-quenching of the ROS on the fabrics was not severe in the tested concentration range of 2-AQS. High concentration of 2-AQS on surfaces of the fibers may block its access to a hydrogen donor in path I reaction (R-H in FIG. 2A), without affecting the path II reaction, and consequently reduce the generation of ·OH. However, the adsorption amount of RB, as well as the $^1O_2$ production, on the RB-polyDEAE@cotton reached saturation when the initial dyeing concentration of RB was 1000 mg/L.

In certain aspects, as a brief summary, by taking the merit of the strong electrostatic interaction between the polyDEAE cationic short chains on the cotton fibers and the anionic PSs, the photoactivity of PSs was successfully retained on the substrate, allowing the resultant PIFs as potential biocidal functional materials for applications in personal protective equipment like cloth mask and protective suits against pathogen attack.

In certain aspects, to obtain insight on the biocidal function of the PIFs, RB-polyDEAE@cotton and 2-AQS-polyDEAE@cotton were challenged by directly contacting with bacteria. The PIFs were inoculated with *E. coli* (Gram-negative) and *L. innocua* (Gram-positive) suspensions individually and then exposed to daylight illumination for 30 min or 60 min. The bacteria reduction rates on the PIFs were determined by comparing the ratios of colony counts from different PIFs and pristine cotton samples (Table 1). The pristine cotton presents no biocidal functions while the quaternary ammonium salts on the polyDEAE@cotton lead to rather limited antibacterial performance under both light and dark conditions (reduction around 1-2 logs). Without light exposures, however, the biocidal functions of PS-dyed PIFs were decreased and finally eliminated with increasing amounts of anionic PSs on the fabrics (Table 1A).

TABLE 1A

Antibacterial function of PS-functionalized polyDEAE@cotton fabrics under dark condition (60 min).

| Samples | Reduction rate of bacterial count (%) | |
|---|---|---|
| | *E. coli* ($10^6$ CFU/mL) | *L. innocua* ($10^5$ CFU/mL) |
| Pristine cotton | 0.00% | 0.00% |
| polyDEAE@cotton | 72.20% | 95.72% |
| 50 mg/L RB | 0.00% | 0.00% |
| 100 mg/L RB | 0.00% | 0.00% |
| 250 mg/L RB | 0.00% | 0.00% |
| 250 mg/L AQS | 20.00% | 0.00% |
| 500 mg/L AQS | 0.00% | 0.00% |

Therefore, the bacteria reduction on the PIFs under the daylight illumination is solely attributed to the photo-induced ROS oxidations. Residual excess cationic polyDEAE sites should still exist on the PIFs but did not show noticeable biocidal outcomes. However, their affinity to the anionic microorganism is expected to facilitate the antibacterial and antiviral functions of the PIFs.

In certain aspects, as summarized in Table 1B, both *E. coli* and *L. innocua* appeared to be susceptible to the PIFs under light illumination. Interestingly, with increasing the initial RB concentration from 50 mg/L to 250 mg/L, the biocidal function of the PIFs dropped dramatically, especially under short-term light exposure (e.g., 30 min). The hydrophobicity of the RB-polyDEAE@cotton increased by having more hydrophobic RB aggregated on the surface, reducing contact of the surface with microorganisms and potentially lowering the biocidal function of the PIFs. However, this issue was not observed in 2-AQS-dyed PIFs, and its killing efficiency toward both *E. coli* and *L. innocua* can be improved by increasing the amount of 2-AQS on the fabrics (Table 1B). Here, the surface properties of the PIFs modified by different concentrations of RB and 2-AQS was examined by measuring their water contact angles (WCAs) (Table 1B). The hydrophobicity increase of the PIFs would reduce surface contact and lower the reduction against bacteria. For RB-incorporated PIFs, the initial concentration at 50 mg/L achieved the best killing performance against both *E. coli* and *L. innocua*, exhibited bacteria reduction rates of 99.99% and 99.9999% with 30 min and 60 min daylight exposure, respectively. The PIFs dyed by 2-AQS also showcased effective biocidal functions with 5-6 logs of reductions against both gram-positive and gram-negative bacteria after 60 min light exposure (Table 1B).

TABLE 1B

Surface hydrophobicity and daylight-induced antibacterial function of PS-adsorbed polyDEAE @ cotton fabrics.

| Samples | WCA (°) | Reduction rate of bacterial count (%) | | | |
|---|---|---|---|---|---|
| | | *E. coli* ($10^6$ CFU/mL) | | *L. innocua* ($10^5$ CFU/mL) | |
| | (1 s/20 s) | 30 min | 60 min | 30 min | 60 min |
| Pristine cotton | 0/0 | 0.00% | 0.00% | 0.00% | 0.00% |
| polyDEAE @ cotton | 0/0 | 98.50% | 99.25% | 85.75% | 96.19% |
| 50 mg/L RB | 108.2/0 | 99.99% | 99.9999% | 99.999% | 99.999% |
| 100 mg/L RB | 114.2/0 | 77.50% | 99.99% | 99.999% | 99.999% |
| 250 mg/L RB | 122.0/120.0 | 6.07% | 99.29% | 99.98% | 99.999% |
| 250 mg/L AQS | 85.0/0 | 99.97% | 99.9999% | 99.98% | 99.98% |
| 500 mg/L AQS | 110.0/0 | 99.9999% | 99.9999% | 99.999% | 99.999% |

In certain aspects, the use of electrostatic interaction to functionalize polyDEAE@cotton with PSs opens a new approach to produce novel functional textiles, and consequently the cationic cotton could serve as a platform. With such a hypothesis, cotton fabrics modified with other cationic moieties can also be applied as the substrate. For instance, (2-chloro-2-hydroxypropyl)-trimethylammonium chloride (CHPTAC) was developed to treat cotton fabrics for salt-free reactive dyeing and could be a potential alternative. (Fu, S.; Hinks, D.; Hauser, P.; Ankeny, M. High Efficiency Ultra-Deep Dyeing of Cotton via Mercerization and Cationization. *Cellulose* 2013, 20 (6), 3101-3110.) The cotton fabrics were modified with CHPTAC (CHPTAC@cotton) according to a reaction shown in Scheme 2, and the treated cotton were employed to adsorb RB and 2-AQS. At the initial concentrations of RB (100 mg/L) and 2-AQS (250 mg/L), the adsorption amounts of both agents on the CHPTAC@cotton were 5.719 mg/g (RB) and 12.346 mg/g (2-AQS), respectively, comparable to that adsorbed on the polyDEAE@cotton.

Scheme 2. Modification reaction of cotton by CHPTAC.

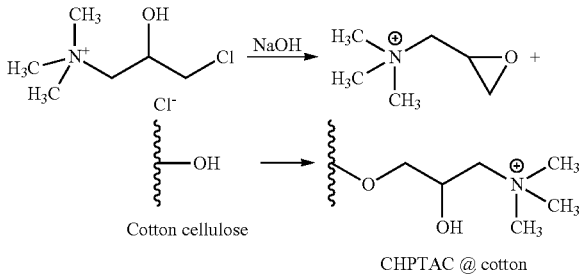

As summarized in Table 2, the resultant PIFs showed efficient antibacterial functions against both *E. coli* and *L. innocua*, with reduction rates examined around 2-6 logs under 60 min daylight illumination.

In certain aspects, the presence of excessive polyDEAE cationic sites on the fabric could provide strong interactions toward anionic cell membranes of microorganisms, improving the biocidal efficiency of the PIFs due to the improved surface contacts. (Terada, A.; Okuyama, K.; Nishikawa, M.; Tsuneda, S.; Hosomi, M. The Effect of Surface Charge Property on *Escherichia Coli* Initial Adhesion and Subsequent Biofilm Formation. *Biotechnol. Bioeng.* 2012, 109 (7), 1745-1754; Mi, X.; Bromley, E. K.; Joshi, P. U.; Long, F.; Heldt, C. L. Virus Isoelectric Point Determination Using Single-Particle Chemical Force Microscopy. *Langmuir* 2020, 36 (1), 370-378.) As a proof of this hypothesis, an anionic protein of BSA was selected as a microorganism mimic to evaluate the affinity between the PIFs and pathogenic microorganisms.

Figure 3A:
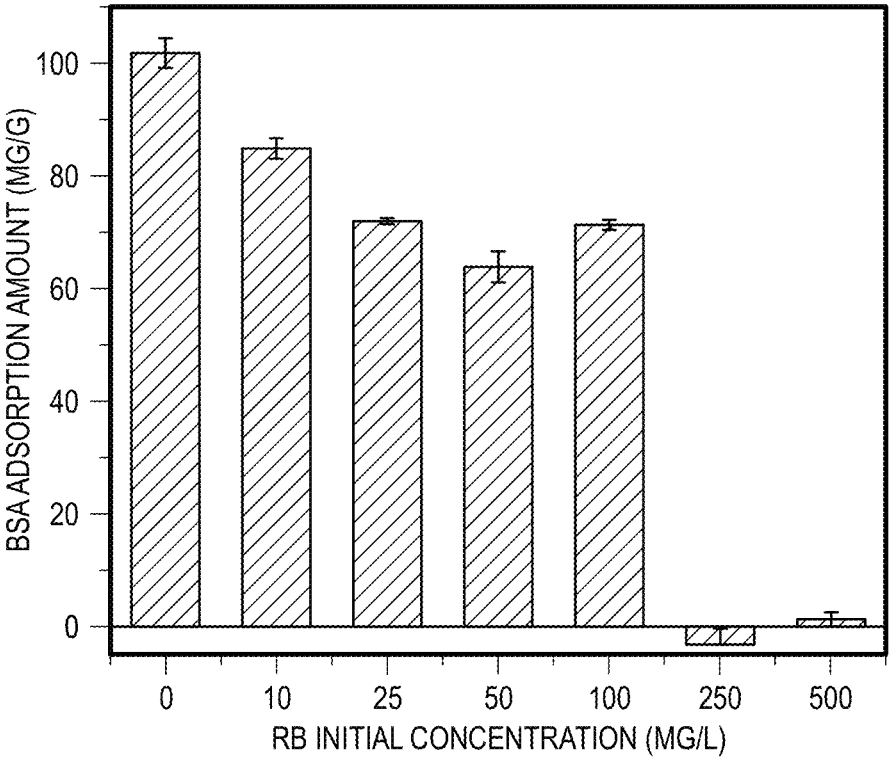
FIG. 3A illustrates adsorption of negatively charged protein (BSA) on RB-polyDEAE@cotton.
Figure 3B:
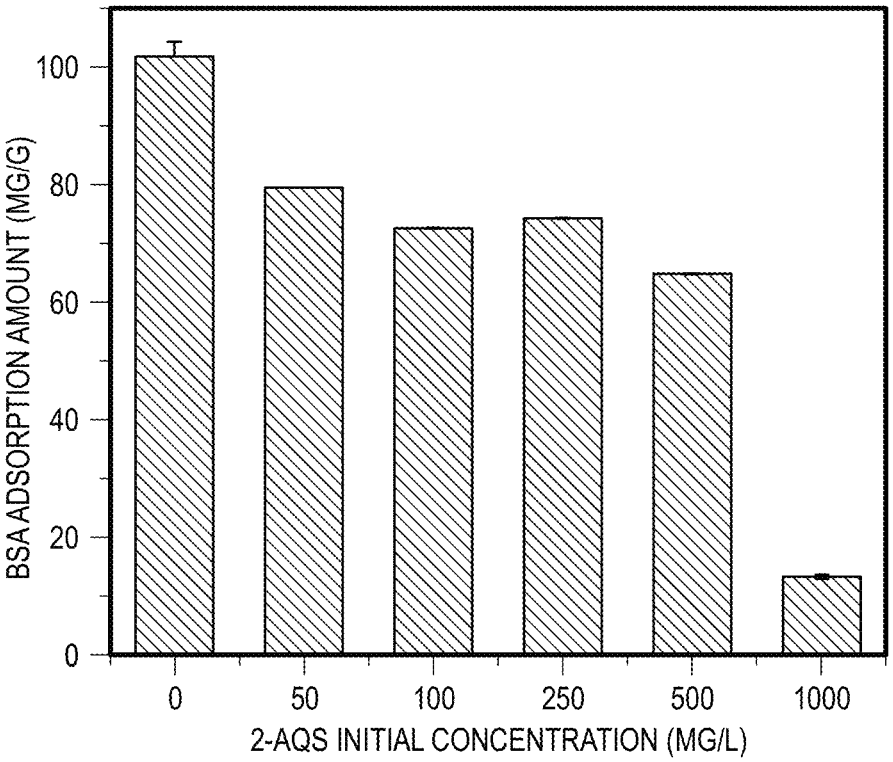
FIG. 3B illustrates 2-AQS-polyDEAE@cotton.
Figure 3C:
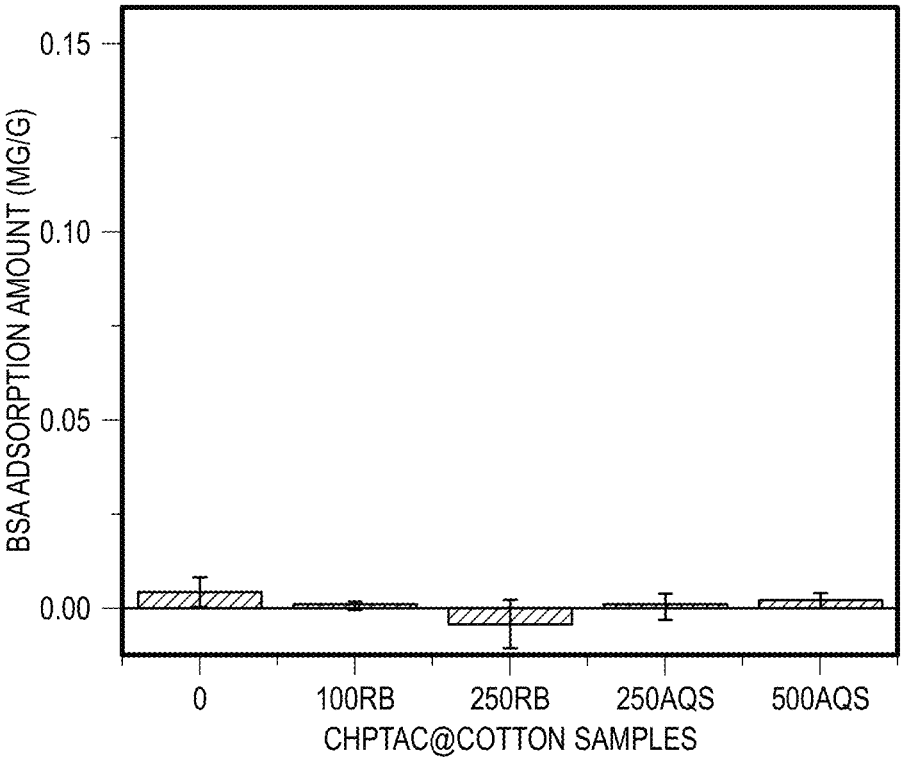
FIG. 3C illustrates CHPTAC@cotton dyed with different initial concentrations of RB and 2-AQS.

As shown in FIG. 3A, once the initial dyeing concentration of RB reached 250 mg/L, the cationic sites on the RB-polyDEAE@cotton became almost fully covered, and the fabric lost its affinity toward negatively charged BSA. Similarly, almost all cationic sites on the 2-AQS-polyDEAE@cotton were consumed by 2-AQS when its initial dyeing concentration reached 1000 mg/L, and the fabric showed a negligible affinity to extra anionic proteins (FIG. 3B). On the other hand, the adsorption affinities between the CHPTAC@cotton, RB-CHPTAC@cotton, 2-AQS-CHPTAC@cotton and BSA were very weak, presenting almost no protein adsorption in FIG. 3C. This fact can be explained as the relatively weak attractive force of single cationic sites on the CHPTAC@cotton toward large molecules of anionic proteins, and this phenomenon was reported in literature. (Xu, Y.; Takai, M.; Ishihara, K. Protein Adsorption and Cell Adhesion on Cationic, Neutral, and Anionic 2-Methacryloyloxyethyl Phosphorylcholine Copolymer Surfaces. *Biomaterials* 2009, 30 (28), 4930-4938.) In this case, the existence of the polyDEAE cationic short chains on the cotton ensures the sufficient adsorption of anionic PSs on the surface and provide additional attractions to anionic microorganisms.

In certain aspects, with comparable amounts of PS adsorbed on both polyDEAE@cotton and CHPTAC@cotton, the lack of extra interaction toward microorganisms of the CHPTAC@cotton resulted in less efficient biocidal functions. Upon 60 min daylight irradiation, the reduction rates of *E. coli* and *L. innocua* by RB-CHPTAC@cotton were about 2 logs lower than that of the RB-polyDEAE@cotton (Tables 1 and 2). Nevertheless, the biocidal efficiency difference was blurred when 2-AQS was employed on the PIFs, since ·OH is a reactive and less selective oxidant than $^1O_2$ (Kaur, R.; Anastasio, C. Light Absorption and the Photoformation of Hydroxyl Radical and Singlet Oxygen in Fog Waters. *Atmos. Environ.* 2017, 164, 387-397), which can be generated by 2-AQS under light illumination. Overall, the CHPTAC@cotton still can serve as a good intermedia for effectively incorporating reactive species to provide desired photo-active functions.

TABLE 2

Daylight-induced antibacterial function of PS-adsorbed CHPTAC@cotton fabrics.

| Samples | Reduction rate of bacterial count (%) | |
|---|---|---|
| | *E. coli* ($10^6$ CFU/mL) 60 min | *L. innocua* ($10^5$ CFU/mL) 60 min |
| Pristine cotton | 0.00% | 0.00% |
| CHPTAC@cotton | 99.52% | 50.00% |

TABLE 2-continued

Daylight-induced antibacterial function of PS-adsorbed CHPTAC@cotton fabrics.

| Samples | Reduction rate of bacterial count (%) | |
|---|---|---|
| | *E. coli* ($10^6$ CFU/mL) 60 min | *L. innocua* ($10^5$ CFU/mL) 60 min |
| 100 mg/L RB | 99.98% | 99.999% |
| 250 mg/L AQS | 99.9999% | 99.97% |

Figure 4A:
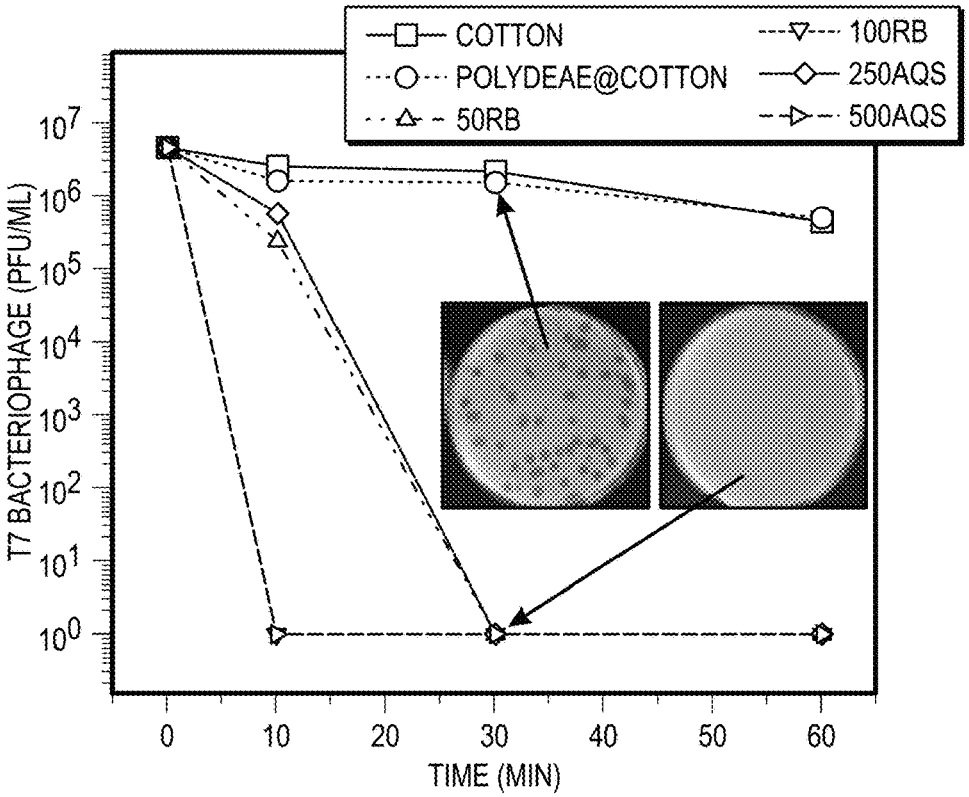
FIG. 4A illustrates antiviral results of polyDEAE@cotton based PIFs with daylight illumination.
Figure 4B:
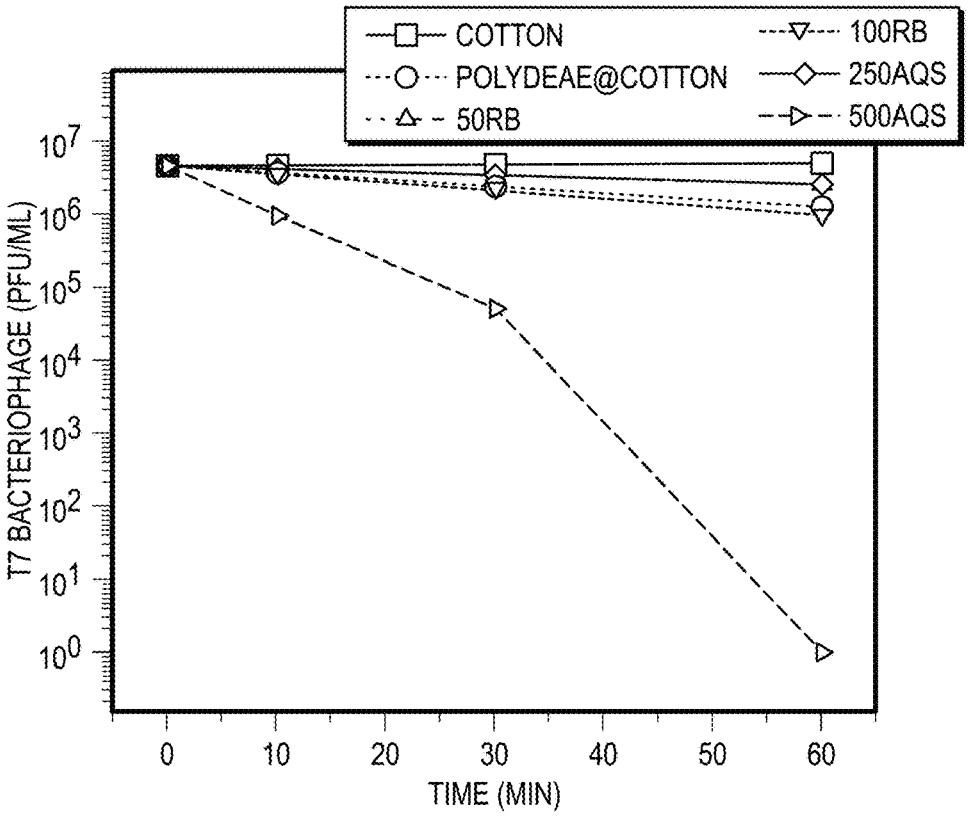
FIG. 4B illustrates antiviral results of polyDEAE@cotton based PIFs under dark condition.

In certain aspects, the generation of strong oxidants of ROSs by PIFs under daylight makes the biocidal function non-selective and can be applied for a broad-spectrum of biological applications. To get an insight on the bioprotective function of PIFs against viruses, T7 bacteriophage was selected as a surrogate of mammalian viruses to inoculate onto the PIFs under daylight illumination, since early results indicated that T7 bacteriophage was more resistant to ROS than some coronavirus. (Zhang, Z.; El-Moghazy, A.; Wisuthiphaet, N.; Nitin, N.; Castillo, D.; Murphy B.; Sun, G. Daylight-Induced Antibacterial and Antiviral Nanofibrous Membranes Containing Vitamin K Derivatives for Personal Protective Equipment. Submitted to *ACS Appl. Mater. Interfaces.* 2020.) Cotton and polyDEAE@cotton showed no obvious biocidal functions against T7 bacteriophage either with light exposure or under dark (FIGS. 4A and 4B). On the contrary, the PIFs containing different amounts of RB or 2-AQS present rapid and efficient killing of T7 bacteriophage, resulting in more than 6 log reduction of plaque-forming units (PFU) with 30 min or longer contact under daylight exposures. It further proved that the antiviral function of the PIFs is highly attributed to the efficient generation of ROS by the PSs under daylight exposure. Excitingly, the complete kill of the T7 phage (6 logs PFU) can even be achieved in only 10 min of contact with PIFs dyed with higher concentrations of PSs, such as 100 mg/L RB and 500 mg/L 2-AQS, though there were 16.52% and 79.13% of the virus PFU decreases on the PIF under the dark condition (FIGS. 4A and 4B). 2-AQS itself might be toxic to T7 bacteriophage, especially in high concentration (FIG. 4B).

Figure 4C:
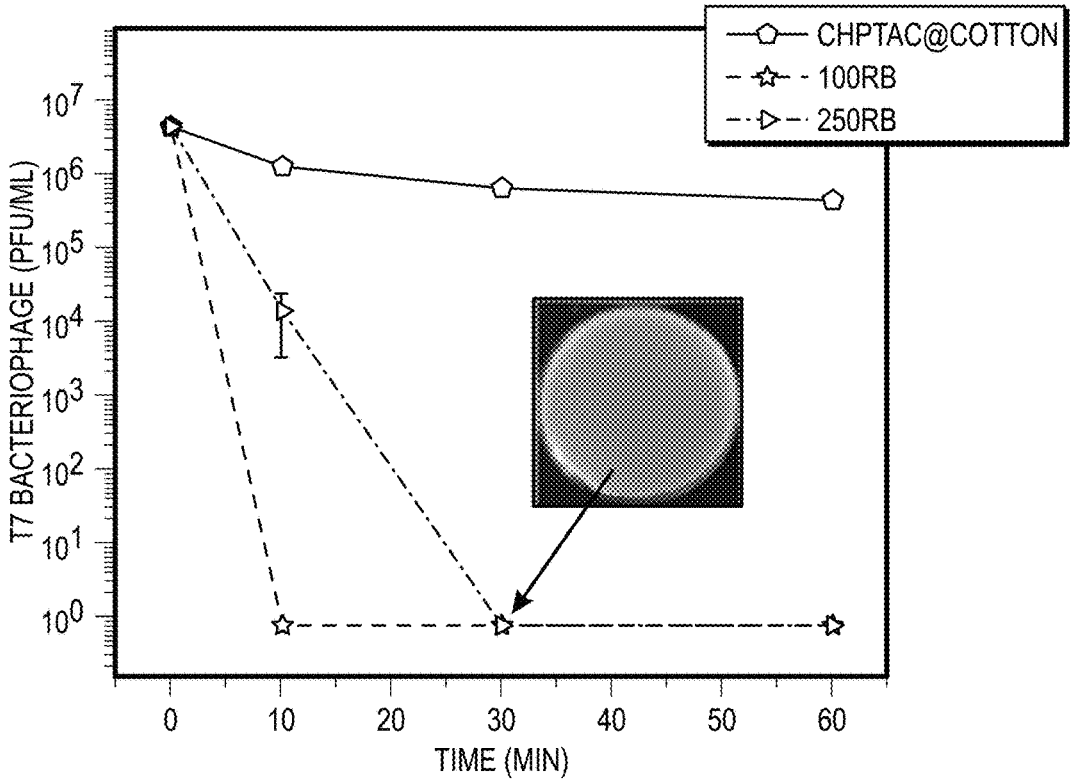
FIG. 4C illustrates antiviral results of CHPTAC@cotton based PIFs with daylight illumination.
Figure 4D:
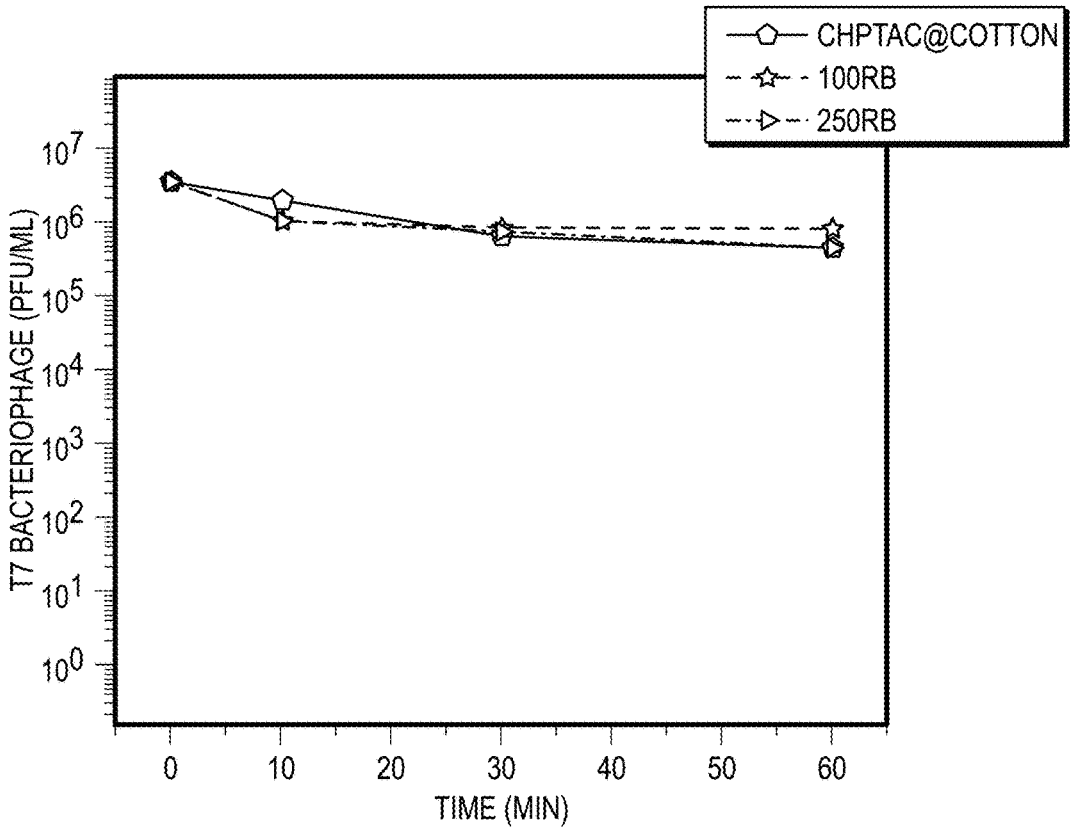
FIG. 4D illustrates antiviral results of CHPTAC@cotton based PIFs under dark condition. The inserted photo in FIG. 4A illustrates the virus count on pristine cotton (left) and PIFs (right) after 30 min daylight illumination. The inserted photo in FIG. 4C showcases the virus count on CHPTAC@cotton-based PIF after 30 min daylight illumination.

In certain aspects, the PIFs modified on CHPTAC@cotton with 100 mg/L RB or 250 mg/L 2-AQS also showcased highly efficient killing effects against T7 bacteriophage (FIG. 4C). Again, CHPTAC@cotton performed no biocidal functions regardless of light illumination. A 6 log reduction of T7 bacteriophage was achieved on RB-CHPTAC@cotton and 2-AQS-CHPTAC@cotton after 10 min and 30 min of daylight exposure, respectively. Meanwhile, there were negligible decreases of bacteriophage colony on the PIFs under dark (FIG. 4D), which further demonstrated the essential role of ROS that generated on the PIFs for ensuring the bioprotective function. See Table 3 below.

Antiviral Results:

Daylight-induced antiviral function of PS-adsorbed polyDEAE@cotton fabrics.

| Under daylight | Reduction rate of virus count (%) Bacterial Phage T7 ($10^6$ CFU/mL) | | |
|---|---|---|---|
| Samples | 10 min | 30 min | 60 min |
| Pristine cotton | 0.00% | 22.52% | 83.80% |
| 100 mg/L RB-polyDEAE@cotton | 100% | 100% | 100% |

-continued

| Daylight-induced antiviral function of PS-adsorbed polyDEAE@cotton fabrics. | | | |
|---|---|---|---|
| 500 mg/L AQS-polyDEAE@cotton | 100% | 100% | 100% |
| 1000 mg/L L AQS polyDEAE@cotton | 100% | 100% | 100% |

| Under dark | Reduction rate of virus count (%) Bacterial Phage T7 ($10^6$ CFU/mL) | | |
|---|---|---|---|
| Samples | 10 min | 30 min | 60 min |
| Pristine cotton | 0.00% | 0.00% | 0.00% |
| 100 mg/L RB-polyDEAE@cotton | 16.52% | 42.35% | 81.89% |
| 500 mg/L AQS-polyDEAE@cotton | 79.13% | 98.82% | 100% |
| 1000 mg/L L AQS polyDEAE@cotton | 100% | 100% | 100% |

In certain aspects, the results proved the broad application potential of using cationic cotton as a platform for cotton fabrics functionalization by anionic photosensitizers as photo-induced biocidal agents. Rose Bengal on cationic or polycationic cotton (RB-polyDEAE@cotton) seems an ideal combination.

In certain aspects, the wash durability and photostability of the PIFs are beneficial for their long-term use in practical applications, and PIFs made from polyDEAE@cotton were selected. The first-time wash of the PIFs was performed in a soap water at 40° C. for 45 min. As shown in Table 4, the PIFs retained their efficient antibacterial functions after the first washing. More interestingly, the PIF dyed in 100 mg/mL of RB presents an increased (1 log higher) bacterial reduction after the first wash, which could be caused by increased surface hydrophilicity. Although the washing with anionic surfactants could remove certain surface adsorbed RB from the PIFs, the strong electrostatic interactions of polyDEAE cationic chains with RB molecules, as well as the hydrophobic nature of RB, slowed down the further removal of the photoactive agents from the fabrics. Meanwhile, there is no dye leaching from the PIFs when the fabrics were immersed in water without surfactants. To further prove the feature of the fabrics, a Launder-O-Meter washing procedure was applied to the PIFs dyed with 50 mg/L and 100 mg/L RB. According to AATCC Test Method 61-1996, each washing process is equivalent to 5 times of household hand wash. (Launder-O-Meter AATCC Test Method 61-1996 Colorfastness to Laundering, Home and Commercial: Accelerated) The samples were additionally washed in a Launder-O-Meter for another two times, and then the samples were challenged with both *E. coli* and *L. innocua* under 60 min daylight illumination.

The PIFs successfully maintained their efficient biocidal functions against *E. coli* and *L. innocua*. Even after 2 times washing, equivalent to 10 times of hand washes, the RB-polyDEAE@cotton still exhibited 3-5 logs of bacterial reduction (Table 4). On the other hand, 2-AQS molecules on the 2-AQS-dyed PIFs were less tolerant to the washing process, possibly due to its high hydrophilicity. Antibacterial functions of the fabric dropped to only 65.71% and 99.94% reduction to *E. coli* and *L. innocua*, respectively (Table 4). In this regard, 2-AQS-dyed PIFs might not be ideal for long-term application and reuse, so no further Launder-O-Meter washing was performed on 2-AQS-dyed PIFs.

In certain aspects, photosensitizers (PSs) will suffer from photobleaching under light illumination and gradually lose their functions during long-term usage even without any biological burdens. Therefore, the PIFs, including RB- and 2-AQS-dyed fabrics, were challenged by continuous daylight exposure for 7 days, then their retained antibacterial functions were examined. Again, the longtime daylight challenge can cause color fading of the PIFs, whereas the antibacterial function of the RB-dyed PIFs retained. Nevertheless, a slight decrease of the biocidal functions of 2-AQS-dyed PIFs was noticed. The results are shown in Table 4.

In certain aspects, RB-dyed PIFs possess much better wash durability and photostability than that of the one dyed with 2-AQS, making the former one more promising as fabric materials to be used in reusable and antibacterial/antiviral cloth face mask and protective suits for improving protection against the transmission of COVID-19 and other infectious diseases. See Table 4 below.

Wash durability and photostability of PS-dyed polyDEAE @ cotton fabrics in terms of antibacterial functions (60 min daylight irradiation).

| | Reduction rate of tacterial count (%) | | | | | | | | | |
|---|---|---|---|---|---|---|---|---|---|---|
| | *E. coli* ($10^6$ CFU/mL) | | | | | *L. innocua* ($10^5$ CFU/mL) | | | | |
| Samples | Before wash | 1st wash | 2nd wash* | 3rd wash* | After 7 days light exposure | Before wash | 1st wash | 2nd wash* | 3rd wash* | After 7 days light exposure |
| 50 mg/L RB | 99.9999% | 99.9997% | 99.9999% | 99.9999% | 99.9999% | 99.999% | 99.98% | 99.9999% | 99.9999% | 99.999% |
| 100 mg/L RB | 99.99% | 99.9995% | 99.99% | 99.98% | 99.9999% | 99.999% | 99.999% | 99.999% | 99.999% | 99.999% |
| 250 mg/L AQS | 99.9999% | 65.71% | — | — | 99.74% | 99.999% | 99.94% | — | — | 98.10% |

*The wash was performed with Launder-O-Meter and each washing equals to 5 times of household hand washes.

In certain aspects, a novel approach for fabricating daylight-induced antibacterial/antiviral cotton fabrics (PIFs) is provided via chemisorption of anionic photosensitizers on cationic cotton fabrics. The cationic cotton cloth was successfully achieved by covalently modifying the cotton with two chemical agents, DEAE-Cl or CHPTAC, respectively, and revealed potential to serve as platforms for developments of functional textiles. The strong electrostatic interactions provided by cationic cotton with anionic rose Bengal or 2-AQS ensured sufficient adsorption capacity and washing durability of the photo-active agents on the materials. The resultant PIFs showcased a highly efficient biocidal effect against bacteria (e.g., *E. coli* and *L. innocua*) and a surrogate of viruses (T7 bacteriophage) with microorganism reduction rates around 5-6 logs under daylight treatment no longer than 60 min. Moreover, the presence of cationic or polycationic short chains on the polyDEAE@cotton further facilitated the biocidal functions by providing the same electrostatic affinity to microorganisms. On the other hand, the PIFs dyed by RB showed excellent wash durability (up to 10 times hand wash) and photostability.

II. Examples

Materials and Methods

Chemicals

Plain cotton fabrics Style 400 (weighting 98 g/m$^2$, 60×60) was purchased from TestFabrics Inc. (West Pittston, PA, USA). 2-Diethylaminoethyl chloride (DEAE-Cl), rose Bengal sodium salt (RB) (dye content ~60%), sodium 2-anthraquinone sulfate monohydrate (2-AQS), and L-histidine were bought from Sigma-Aldrich (St. Louis, MO, USA). (2-Chloro-2-hydroxypropyl)-trimethylammonium chloride (CHPTAC) was purchased from TCI (Portland, OR, USA). N, N'-Dimethyl-4-nitrosoaniline (p-NDA) was bought from Spectrum Chemicals & Laboratory Products (Gardena, CA, USA). All the chemicals were used as received without further purifications.

Cotton Modification with DEAE-Cl, CHPTAC and In Situ Growth of Porous Organic Polymers Cotton fabrics were activated in NaOH solution (120 g/L) at room temperature for 40 min. The liquor ratio was controlled at 1:50. Specific concentration of DEAE-Cl was prepared in isopropanol (IPA) (liquor ratio=1:50). The activated cotton fabrics were removed from the NaOH system and transferred into the DEAE-Cl/IPA solution. The modification reaction is performed at 60° C. for 60 min. Then, the DEAE-Cl modified cotton fabrics (polyDEAE@cotton) were washed with an excess amount of deionized water and dried at 80° C. for 5 min.

The modification of cotton fabric by CHPTAC was performed by treating the fabric in 50 g/L NaOH solution at room temperature for 30 min. Then, CHPTAC was added to reach a final concentration of 30 g/L. The mixture was further reacted at 80° C. for 60 min. The resultant fabric, denoted as CHPTAC@cotton, was washed with deionized water and dried at 80° C. for 5 min.

The cotton fabrics (5 cm×5 cm, 2 pieces) were activated by reacting with cyanuric chloride (CCl) in DMAc at 0° C. for 1 hour in an ice-water bath. The CCl solution was prepared by dis-solving CCl (4.5 mmol) in 60 mL DMAc with 1 mL of triethylamine ($Et_3N$). Secondly, the CCl-activated cotton fabrics were transferred into 90 mL of DMSO containing melamine (5.6 mmol) and 1 mL $Et_3N$ in a 250 mL round-bottom flask. Then, 30 mL of additional CCl (2.8 mmol) in DMSO was added into the flask dropwise under stirring and N2 gas purging for at least 20 min. The reaction system was well-sealed and heated to 150° C. within 60 min and kept stirring at 500 rpm for 24 hours. The as-obtained POP@cotton was washed with DMSO, deionized water and methanol after cooling the system back to room temperature. The POP@cotton was dried under vacuum at room temperature.

Functionalization of PolyDEAE@Cotton with Photosensitizers

Two anionic photosensitizers of rose Bengal (RB) and sodium anthraquinone-2-sulfonate (2-AQS) were selected to functionalize cationic cotton for achieving daylight-induced antibacterial/antiviral functions as PIFs, which was easily performed under traditional dyeing process. Taking polyDEAE@cotton as an example, photosensitizer solutions were prepared by dissolving a specific amount of RB or 2-AQS in deionized water and were used as dyeing solutions. A fabric to PS solution ratio (liquor ratio) was controlled at 1:50. The solution pH was adjusted to 6.0 with 0.1 M HCl solution. For RB dyeing, firstly, the polyDEAE@cotton or pristine cotton was wetted by water and squeezed before putting into the dyeing bath (60° C.) for 10 min. Afterward, the temperature of the dyeing bath was elevated to 90° C. within 10 min, and the RB dyeing was further continued for 30 min at 90° C. On the other hand, the dyeing of 2-AQS was accomplished at 60° C. for 40 min. Then, the dyed fabrics were washed thoroughly with soap water and cold water and dried at 80° C. for 5 min. The adsorption amounts of PSs on the fabrics were measured based on the PS concentration changes after the dyeing. The calibration curves for quantify the concentrations of RB ($C_{RB}$) and 2-AQS ($C_{2\text{-}AQS}$) in mg/L are $A_{550}=0.0093\times C_{RB}-0.0322$ ($R^2=0.9935$), and $A_{330}=0.016\times C_{2\text{-}AQS}+0.012$ ($R^2=1.0000$), respectively.

Characterizations

Scanning electron microscope (SEM) images were captured using a FE-SEM (Quattra ESEM, Thermo Fisher Scientific, USA). Thermogravimetric analysis (TGA) was performed with a TGA-60 system (Shimadzu Science Instruments, Inc., USA). The sample weight was around 10 mg. Firstly, the sample was heated from room temperature to 120° C. (rate=20° C./min) and held for 3 min to eliminate free water with $N_2$ flow (30 mL/min). Then, the sample was cooled to room temperature with protection of $N_2$ atmosphere and reheated to 600° C. (rate=10° C./min).

The presence of cationic or polycationic short chains on the cellulose surface was proved and evaluated by an indirect method: adsorption of negatively charged protein of bovine serum albumin (BSA). In detail, around 200 mg of PIF was immersed in 1 g/L BSA solution (pH=7.4) and stored at 4° C. for 24 hours. The BSA concentration before and after fabric adsorption was quantified with bicinchoninic acid (BCA) protein assay. The testing solution was prepared by mixing 2 mL BCA reagent A, 40 μL BCA reagent B, and 100 μL sample solution. The mixture was incubated at 37° C. for 30 min, then the color intensity of the mixture was monitored by a UV-vis spectrophotometer. The BSA concentration in g/L ($C_{BSA}$) was calculated based on the absorbance intensity at a wavelength of 560 nm ($A_{560}$) according to an established calibration curve of $C_{BSA}=1.2171\times A_{560}-0.1355$, $R^2=0.9957$. The water contact angle of the fabrics was measured by Dino-Lite microscope (Dunwell Tech. Inc, USA) by dropping 10 μL of distilled water on the fabric, the images at a specific time interval after water-dropping were captured with DinoCapture 2.0.

Measurement of ROS

Figure 5:
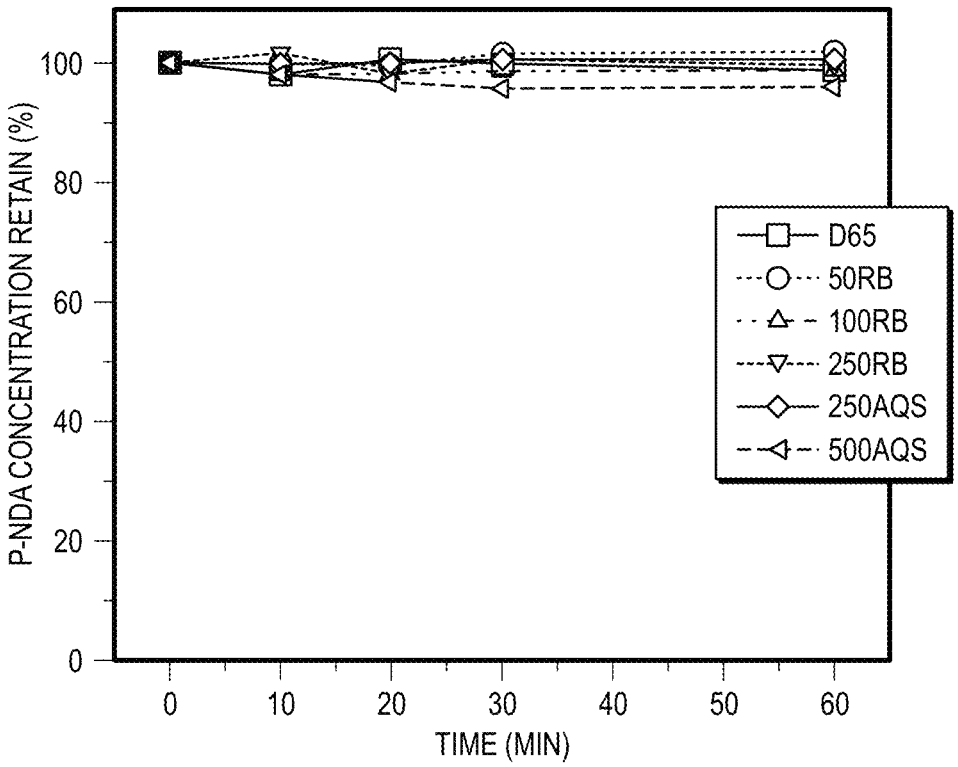
FIG. 5 illustrates p-NDA concentration changes without PIFs under daylight illumination and with polyDEAE@cotton-based PIFs under dark condition.

Here, p-Nitrosodimethylaniline (p-NDA) was selected as a highly selective hydroxyl radical scavenger for ROS measurements. (Tang, P.; Sun, G. Generation of Hydroxyl Radicals and Effective Whitening of Cotton Fabrics by $H_2O_2$ under UVB Irradiation. *Carbohydr. Polym.* 2017, 160, 153-162; Zhang, Z.; Si, Y.; Sun, G. Photoactivities of Vitamin K Derivatives and Potential Applications as Daylight-Activated Antimicrobial Agents. *ACS Sustain. Chem. Eng.* 2019, 7 (22), 18493-18504.) PIF (2 cm×2 cm) was immersed in 10 mL 40 μM p-NDA solution in a glass petri dish. Then, the samples were exposed to daylight in an XL-1500 crosslinker for 30 min. The light intensity in the crosslinker was measured by alight meter (EXTECH, Model #LT300) as 13000 Lux. As a reference, the light intensity of outdoor under the sun (on Jul. 22, 2020, in Davis, CA, USA), outdoor in the shade (on Jul. 22, 2020, in Davis, CA, USA), in office, and in a supermarket was measured as 87000 Lux, 3000 Lux, 1000 Lux, and 600 Lux, respectively. The color fading of the p-NDA solution, contributed to the quenching by hydroxyl radicals produced from the PIF, was detected with UV-vis spectrophotometer. The concentrations of p-NDA solution in $1\times10^{-5}$ M ($C_{p\text{-}NDA}$) before and after light illumination were calculated according to a calibration curve ($A_{440}=0.3387\times C_{p\text{-}NDA}-0.0095$, $R^2=0.9998$), the maximum absorption intensity at a wavelength of 440 nm ($A_{440}$) was recorded. The concentration change of the p-NDA ($\Delta C_{p\text{-}NDA1}$) was applied to evaluate the production of hydroxyl radicals by PIFs. For testing the generation of singlet oxygen from PIFs, 0.01 M L-histidine was added into the p-NDA solution. (Zhang, Z.; Si, Y.; Sun, G. Photoactivities of Vitamin K Derivatives and Potential Applications as Daylight-Activated Antimicrobial Agents. *ACS Sustain. Chem. Eng.* 2019, 7 (22), 18493-18504.) In this case, the decrease of the p-NDA concentration ($\Delta C_{p\text{-}NDA2}$) was attributed to the quenching of p-NDA by hydroxyl radicals and the singlet oxygen oxidized L-histidine. The production of singlet oxygen by PIFs under daylight illumination can be evaluated by the difference between $\Delta C_{p\text{-}NDA1}$ and $\Delta C_{p\text{-}NDA2}$. It is important to note that there is no color fading of p-NDA solution either under a dark condition or under light but without PIFs (FIG. 5).

Antibacterial Test

The antibacterial function of PIFs was examined against two model bacteria: gram-negative *Escherichia coli* O157: H7 [American Type Culture Collection 700728] and gram-positive *Listeria innocua* [American Type Culture Collection 33090]. The bacterial culture was processed by mixing *E. coli* and *L. innocua* colonies with 10 mL lysogeny broth and 10 mL trypticase soy broth, respectively, and incubated at 37° C. for 24 hours. Thereafter, around $4\times10^6$ CFU $mL^{-1}$ *E. coli* and $1\times10^5$ *L. innocua* cultures can be obtained for further antibacterial tests.

Before the antibacterial test, the bacterial culture solution was performed two cycles of centrifugation (5000 rpm, 8 min) and washing (10 mL cold phosphate-buffered saline) process. Then, 20 mL of phosphate-buffered saline (PBS) was mixed with bacteria precipitate as the final bacterial culture suspension. PIFs (2 cm×2 cm) were placed in a petri dish and wet with 20 μL of bacterial culture suspension. Here, 0.1 wt % Triton™ X-405 was added in the bacterial culture solution to assist the complete wetting of hydrophobic samples. Then, different fabrics were exposed to daylight in a XL-1500 crosslinker or incubated under the dark condition for different durations. Sterile PBS (20 μL) was dropped on the sample surface every 5 min to avoid the killing effect from elevated temperature during light illumination. After that, the residual bacterial on the fabric was extracted by 1 mL of sterile PBS buffer and were serially diluted ($\times10^0$, $\times10^1$, $\times10^3$, $\times10^5$) to be inoculated on lysogeny agar plate (*E. coli*) or trypticase soy agar plate (*L. innocua*) for bacterial enumeration at 37° C. for 24 hours. The quantification of antibacterial function was evaluated by the plate count of residual bacterial CFU numbers. All the bacterial reduction was calculated based on the CFU number obtained on the pristine cotton, and it showed negligible effects on the killing of bacteria.

Antivirus Test against T7 Bacteriophage

T7 bacteriophage was prepared according to a procedure provided in supporting information. 10 μL of $1\times10^7$ PFU $mL^{-1}$ T7 bacteriophage suspension was uniformly loaded on the surface of PIFs or control samples in a size of 2×2 $cm^2$. The samples were then placed under dark conditions or daylight irradiation for different durations. At each specific time point, the samples were vortexed vigorously with 3 mL of maximum recovery diluent to collect the T7 phages from the fabrics. After 100-fold serial dilutions, 100 μL of the phage dilution was mixed with 200 μL of *E. coli* BL21 ($1\times10^9$ CFU $mL^{-1}$) suspension and incubated for 10 minutes at 37° C. 3 mL of Molten LB agar at 45° C. was then mixed with the T7 phage-*E. coli* mixture, followed by immediately pouring onto a prewarmed LB agar plate. After agar solidification, the plates were incubated overnight at room temperature, after which the phage plaques were counted and standardized to the initial concentration.

Light and Wash Durability Tests

The as-fabricated PIFs were exposed to office light for 7 days. The light intensity was measured by alight meter (EXTECH, Model #LT300) as around 1000 Lux. According to AATCC Test Method 107-2009 and AATCC Test Method 61-1996, the wash durability of the fabrics was performed in a beaker ($1^{st}$ wash) and with a Launder-O-Meter ($2^{nd}$ and $3^{rd}$ washes). For the first-time wash, PIFs were immersed in 300 mL deionized water with 0.3 wt % detergent. The mixture was stirred (200 rmp) for 45 min at 40° C. Then, the fabrics were rinsed with deionized water to remove the detergent and dried at 80° C. for 3 min. By using the Launder-O-Meter, PIFs (2×6 $in^2$) were immersed in 150 mL water containing 0.225 g detergent with 50 steel balls. Then, the washing was performed in the Launder-O-Meter at 50° C. for 45 min. Afterward, the PIFs were rinsed with water and dried at 80° C. for 3 min. The bioprotective functions of the PIFs were evaluated through antibacterial tests. Each time of the washing in the Launder-O-Meter is equivalent to 5 times of household handwashing.

Fabrication of Triazine-Based Cotton Super-Adsorptive Fibrous Equipment (SAFE-Cotton)

Triazine-based highly porous organic polymers (POP) were in situ grown on cotton fibers. Specifically, six pieces of cotton fabrics (5×5 $cm^2$) were first activated by CCl (9.8 mmol) in 100 mL of DMAc at 0° C. in an ice-water bath for one hour. Then, the activated cotton was transferred into 90 mL DMSO containing 5.6 mmol of melamine. While purging nitrogen gas into the reaction system, 30 mL of CCl (2.8 mmol) in DMSO was added dropwise. The reaction system was well-sealed and stirred at 500 rpm at 150° C. for 24 hours. The resultant fabrics were washed by DMSO, deionized water ($H_2O$), and methanol thoroughly. During $H_2O$ washing, sonication (10 min) was applied to remove any weak-adsorbed POP on the SAFE-Cotton. Finally, the SAFE-Cotton was obtained by drying the fabrics under vacuum at 30° C. The grafting ratio of POP on the SAFE-Cotton was measured by weight difference as 11.70%.

Biocidal Functionalization of Cotton-Based Fibrous Materials

The cotton-based biocidal fibrous materials were achieved by incorporating Rose Bengel (RB) onto SAFE-Cotton and CHPTAC@Cotton via a conventional dyeing process at room temperature and elevated temperature, respectively. Different initial RB concentrations were prepared in $H_2O$, and the pH of the dye solution was checked and adjusted to 5.5 if needed. One piece of SAFE-Cotton (5×5 $cm^2$) was immersed in 30 mL of the RB solution for different durations under dark with gentle shaking. On the other hand, one piece of CHPTAC@Cotton (5×5 $cm^2$) was immersed in 30 mL of RB solution at 60° C. for 10 min with stirring. Then, the solution was heated to 80° C. within 10 min and kept at 80° C. for another 30 min. Afterward, the dyed fabrics were rinsed by $H_2O$ and dried at 80° C. for 5 min. The adsorption amount of RB on SAFE-Cotton and CHPTAC@Cotton was quantified by measuring the RB exhaustion by a UV-visible (UV-vis) spectrophotometer. The calibration curve of RB concentration ($C_{RB}$, in a unit of mg/L) versus the light absorbance at 550 nm ($A_{550}$) was examined as $A_{550}=0.0093\times C_{RB}-0.0322$, $R^2=0.9994$. It is important to note that all the RB solutions were diluted by 10 times with $H_2O$ before concentration quantification.

SAFE-Cotton was firstly functionalized by RB solution (100 mg/L) to achieve DBwEE-Cotton100. Then, DBwEE-Cotton100 was cut into the size of 2 cm×2 cm and sealed in a 4 mL glass vial. Different amounts of Mel were injected into the vial and incubated under room temperature and dark for 24 hours. The resulted fabrics were treated under vacuum at room temperature for 60 min to evaporate unreacted Mel.

ROS Production Measurement

Reactive oxygen species, including hydroxyl radical (HO·) and singlet oxygen ($^1O_2$), were measured by p-NDA and p-NDA/L-histidine in phosphate-buffered saline (PBS, pH=7.4), respectively. To avoid the physical adsorption of p-NDA by the fabrics, the fibrous samples were immersed in 50 mL 40 μM of p-NDA solution for 24 hours under dark. Then, the fabric (2×2 $cm^2$, ~50 mg) was immersed in 10 mL 40 μM p-NDA solution in a glass petri dish and exposed to daylight in an XL-1500 crosslinker for different durations for examining ROS production. The light intensity in the crosslinker was measured by a light meter (EXTECH, Model #LT300) as 13000 Lux. The color fading of the p-NDA solution, contributed to the quenching by hydroxyl radicals produced by the sample, was detected with a UV-vis spectrophotometer. The concentrations of p-NDA solution in a unit of $1\times10^{-5}$ M ($C_{p\text{-}NDA}$) before and after light illumination were calculated according to a calibration curve ($A_{440}=0.3387\times C_{p\text{-}NDA}-0.0095$, $R^2=0.9998$), the maximum absorbance at 440 nm ($A_{440}$) was recorded. For testing the generation of singlet oxygen of the sample, 0.01 M L-histidine was added into the p-NDA solution. In this case, the decrease of the p-NDA concentration ($\Delta C_{p\text{-}NDA2}$) was attributed to the quenching of p-NDA by hydroxyl radicals and the singlet oxygen-oxidized L-histidine. Thus, the production of singlet oxygen can be evaluated by the difference between $\Delta C_{p\text{-}NDA1}$ and $\Delta C_{p\text{-}NDA2}$. It is important to note that there is no apparent color fading of p-NDA solution either under a dark condition or under light but without RB-embedded fabrics.

Antibacterial Test

The antibacterial tests were performed according to the American Association of Textile Chemists and Colorists (AATCC) 100 Test Method with modifications. All the reported results were obtained as an average in triplicates. The antibacterial function of DBwEE-Cotton was examined against two model bacteria: gram-negative *Escherichia coli* O157:H7 [American Type Culture Collection 700728](*E. coli*) and gram-positive *Listeria innocua* [American Type Culture Collection 33090](*L. innocua*). First, *E. coli* and *L. innocua* colonies were mixed individually with 10 mL lysogeny broth and 10 mL trypticase soy broth, respectively, and incubated at 37° C. for 24 hours. Then, the bacterial culture suspension was run for two cycles of centrifugation (5000 rpm, 8 min) and washing (10 mL cold PBS). After that, 10 mL of PBS was mixed with bacteria precipitate as the final bacterial culture suspension. Around $2\times10^8$ CFU/mL *E. coli* and $5\times10^6$ *L. innocua* cultures can be obtained for further antibacterial tests. DBwEE-Cotton (2×2 $cm^2$) was placed in a petri dish and be completely wet by 20 μL of bacterial culture suspension. Then, bacteria-contaminated fabrics were exposed to daylight in a XL-1500 crosslinker or incubated under a dark condition for different durations. Sterile PBS (10 μL) was dropped on the sample surface every 5 min to avoid inactivation of the microorganisms from elevated temperature and water evaporation during light illumination. After that, the residual bacteria on the fabric were extracted by 1 mL of sterile PBS and were serially diluted ($\times10^0$, $\times10^1$, $\times10^3$, $\times10^5$) to be inoculated on a lysogeny agar plate or trypticase soy agar plate for *E. coli* and *L. innocua* enumeration at 37° C. for 24 hours, respectively. The antibacterial function of the material was evaluated by the plate count of residual bacterial CFU numbers. All the bacterial reduction was calculated based on the CFU number obtained on the pristine cotton, and it showed negligible effects on the killing of bacteria with either under light or dark conditions.

Results and Discussion

Fabrication of Daylight-Induced Biocidal Cotton with Enhanced Efficiency (DBwEE Cotton)

FIG. 1A displays the fabrication process of SAFE-Cotton and DBwEE-Cotton. The in situ growth of POP was accomplished by using CCl and melamine as precursors. After cotton activation by CCl in an ice-water bath for 60 min, the SAFE-Cotton was finally obtained via a condensation reaction between melamine and CCl. After that, RB was incorporated onto the SAFE-Cotton by adsorption (i.e., dyeing at room temperature) (FIG. 1A). The SEM images visually proved the growth of mesoporous POP on the cotton fibers and showed a negligible effect on the POP morphology after RB adsorption. The color changes of the fabrics were evaluated by CIELab color coordinators, whiteness index, and yellowness index. The obvious color change of the fabric from pale-yellow to shining pink illustrated the sufficient loading of RB on the DBwEE-Cotton, which is one of the crucial factors to the biocidal activity. With the presence of POP on the SAFE-Cotton (grafting ratio=11.70%), it possesses improved BET surface area of 38.95 $m^2/g$ and porosity (pore volume=0.083 mL/g), which are 19 times and 13.8 times higher than that of the pristine cotton (i.e., surface area=2.05 $m^2/g$; pore volume=0.006 mL/g), benefiting the RB functionalization via the guest-host adsorption. The adsorption amount of RB reached saturation (i.e., 18-19 mg/g) when the initial concentration was 250 mg/L or higher. Then, the BET surface area and pore volume of the DBwEE-$Cotton_{100}$ dropped to 6.03 $m^2/g$ and 0.017 mL/g after RB adsorption, respectively. In addition, the mesopore size of SAFE-Cotton and the theoretical molecular diameter of RB were measured as 4.570 nm and around 11 Å, respectively, making RB molecules fit well in the pores of POP. These results demonstrated the filling of the mesopores of the SAFE-Cotton by RB molecules. To understand the mathematical relationship of the RB capture by the POP, the adsorption capacity of the POP particles was examined as 102.58 mg/g after 24-hours of adsorption in a 500 mg/L RB solution (pH=5.5). According to the MALDI-TOF-MS results of the POP particles ([M+H]=877.323), each RB molecule was captured in a mesopore built by 10.83 layers of POP. This phenomenon further ensures the separation of RB molecules inside the POP.

Antibacterial Function of DBwEE-Cotton

The antibacterial properties of the fabrics (i.e., DBwEE-Cotton$_{100}$) were examined by challenging them with both Gram-negative (i.e., *E. coli*) and Gram-positive (i.e., *L. innocua*) bacteria with the exposure to daylight in a XL-1500 crosslinker box for specific durations (e.g., 5, 10, 20, 30, and 60 min). The pristine cotton (2×2 cm$^2$) was contaminated by the bacteria and exposed to light for 60 min as the control. All the bacterial reduction was calculated based on the bacteria count from the pristine cotton samples. 99.9999% of *E. coli* and *L. innocua* were effectively killed within 20 min under daylight exposure, which is much efficient than other traditional biocidal textiles. It is also exciting to notice that the DBwEE-Cotton$_{100}$ rendered 99% and 99.99% of bacterial reduction against both Gram-negative and Gram-positive bacteria with only 5 and 10 min of light exposure, respectively. This rapid bioprotective function of DBwEE-Cotton ensured instant and sufficient protection against lethal pathogens. The washing durability of the DBwEE-Cotton is another factor for its repeated and long-term usages. The fabrics (i.e., DBwEE-Cotton$_{100}$) were washed by water containing 0.15 wt % of AATCC standard detergent at 40° C. for 45 min, which counted as one cycle of washing according to the AATCC Test Method 61-2007. Antibacterial tests were performed on the DBwEE-Cotton$_{100}$ after 1, 3, 5, 10, 15, and 30 times of washes. After 30-min of daylight exposure, *E. coli* (6 log) and *L. innocua* (6 log) were completely inactivated by the fabrics, even after 30 washes. It proved that the electrostatic interaction and the guest-host capture of RB on the DBwEE-Cotton greatly benefit the washing durability of the fabrics. On the other hand, the light stability of the DBwEE-Cotton$_{100}$ was evaluated by bacterial challenges after exposing the fabric to an office light (light intensity=3000 Lux) for six days. Neither *E. coli* nor *L. innocua*, stayed alive on the DBwEE-Cotton$_{100}$ after 30 min of daylight irradiation, which demonstrated the feasibility of DBwEE-Cotton$_{100}$ for long-term applications.

CONCLUSIONS

We designed and demonstrated a unique "posture" of RB on cotton fabrics containing POP, with biocidal activity being significantly enhanced against both Gram-negative (i.e., *E. coli*) and Gram-positive (i.e., *L. innocua*) bacteria. Based on the capture of RB molecules separately in the mesopores of SAFE-Cotton, the aggregation-caused self-quenching of RB on solid support highly diminished. Moreover, the RB on the DBwEE-Cotton was found to undergo both type I and type II photoreactions, thus further improving the biocidal efficiency by producing more ROS for pathogen killings. The occurrence of the type I photoreaction of RB was forced to happen in the POP system, which was realized by closely surrounding RB molecules with massive good H-donors (i.e., POP). As a result, the DBwEE-Cotton$_{100}$ presented highly improved biocidal functions based on the contact killing mechanism. More than 99.9999% of *E. coli* and *L. innocua* were disinfected within 20 min under daylight exposure. The DBwEE-Cotton$_{100}$ also performed excellent washing durability (i.e., 6 log of bacterial reduction after 30 washes) and light stability (i.e., 6 log of bacterial reduction after six days of light exposure).

All publications, patents and patent applications cited in this specification are herein incorporated by reference as if each individual publication, patent or patent application were specifically and individually indicated to be incorporated by reference. Although the foregoing disclosure has been described in some detail by way of illustration and example for purposes of clarity of understanding, it will be readily apparent to those of ordinary skill in the art that, in light of the teachings of this application, that certain changes and modifications may be made thereto without departing from the spirit or scope of the appended claims.

What is claimed is:

1. An antimicrobial fiber, the antimicrobial fiber comprising: a cationic or polycationic moiety grafted onto a fiber containing a nucleophilic functional group which is a member selected from the group consisting of a hydroxyl, an amino and a pyridyl group; and an anionic photosensitizer.

2. The antimicrobial fiber of claim 1, wherein the fiber is cotton or a cotton blend.

3. The antimicrobial fiber of claim 1, wherein the fiber is cotton.

4. The antimicrobial fiber of claim 1, wherein the antimicrobial fiber is antibacterial.

5. The antimicrobial fiber of claim 1, wherein the antimicrobial fiber is antiviral.

6. The antimicrobial fiber of claim 1, wherein the cationic or polycationic moiety grafted onto the fiber is polyDEAE@cotton, which has formula I:

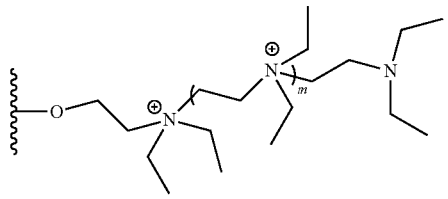

wherein m is a value from 1-10,000.

7. The antimicrobial fiber of claim 1, wherein the cationic or polycationic moiety grafted onto the fiber is CHPTAC@cotton, which has formula II:

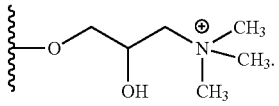

8. The antimicrobial fiber of claim 1, wherein the cationic or polycationic moiety grafted onto the fiber is a POP@cotton, which has formula IIIa or IIIb:

a

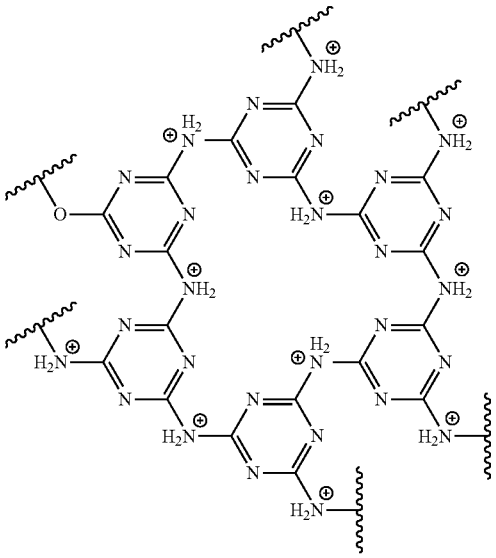

-continued b

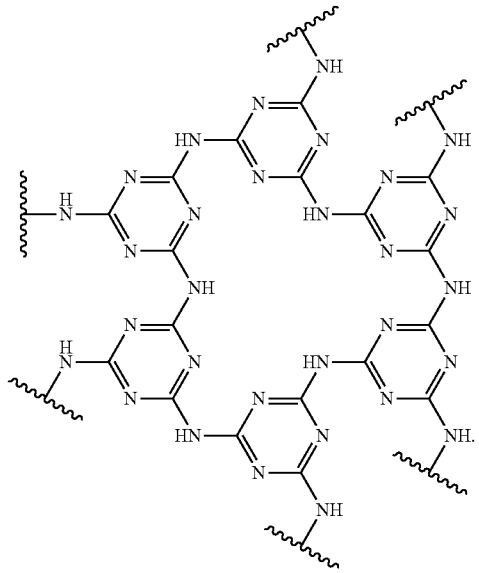

9. The antimicrobial fiber of claim 1, wherein the anionic photosensitizer is a member selected from the group consisting of Rose Bengal, sodium anthraquinone-2-sulfonate, menadione sodium bisulfite (MSB) (soluble $VK_3$), riboflavin (RF), a flavin mononucleotide (FMN), derivatives of vitamin K and flavins.

10. The antimicrobial fiber of claim 9, wherein the anionic photosensitizer is Rose Bengal.

* * * * *